US008220791B2

(12) United States Patent
Suzuki et al.

(10) Patent No.: US 8,220,791 B2
(45) Date of Patent: Jul. 17, 2012

(54) SPINE FORMATION DEVICE, BOOKBINDING SYSTEM, AND CONTROL METHOD THEREFOR

(75) Inventors: Nobuyoshi Suzuki, Tokyo (JP); Shinji Asami, Machida (JP); Naohiro Kikkawa, Kawasaki (JP); Kazuhiro Kobayashi, Kawasaki (JP); Tomohiro Furuhashi, Fujisawa (JP); Kiichiroh Gotoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 12/923,776

(22) Filed: Oct. 7, 2010

(65) Prior Publication Data

US 2011/0103921 A1 May 5, 2011

(30) Foreign Application Priority Data

Oct. 30, 2009 (JP) ..... 2009-250793

(51) Int. Cl.
*B31F 1/10* (2006.01)

(52) U.S. Cl. ..... 270/45; 270/32; 270/58.07

(58) Field of Classification Search ..... 270/32, 270/45, 51, 58.07; 412/22, 30
See application file for complete search history.

(56) References Cited

U.S. PATENT DOCUMENTS

| | | | | |
|---|---|---|---|---|
| 7,562,866 | B2 * | 7/2009 | Hayashi | 270/58.07 |
| 2006/0263174 | A1 | 11/2006 | Oikawa et al. | |
| 2007/0060459 | A1 * | 3/2007 | Hayashi | 493/434 |
| 2009/0036287 | A1 * | 2/2009 | Kawaguchi et al. | 493/442 |
| 2009/0137374 | A1 | 5/2009 | Kobayashi et al. | |
| 2009/0152789 | A1 | 6/2009 | Kikkawa et al. | |
| 2009/0200725 | A1 | 8/2009 | Tamura et al. | |
| 2009/0221411 | A1 | 9/2009 | Endo | |
| 2009/0258774 | A1 | 10/2009 | Suzuki et al. | |
| 2010/0239393 | A1 | 9/2010 | Suzuki et al. | |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |

FOREIGN PATENT DOCUMENTS

EP 1 780 036 5/2007

(Continued)

OTHER PUBLICATIONS

Office Action for corresponding Japanese patent application No. 2009-250793 dated May 31, 2011.

(Continued)

*Primary Examiner* — Leslie A Nicholson, III
(74) *Attorney, Agent, or Firm* — Harness, Dickey & Pierce, P.L.C.

(57) ABSTRACT

An spine formation device includes a sheet conveyer that conveys the bundle of folded sheets with a folded portion of the bundle of folded sheets forming a front end portion of the bundle of folded sheets, a spine formation unit disposed downstream from the sheet conveyer in a sheet conveyance direction for forming the spine of the bundle of folded sheets by squeezing the folded portion of the bundle from a folded leading side, a front side, and a back side of the bundle, a discharge unit to discharge the bundle of folded sheets outside the spine formation device, disposed downstream form the spine formation unit in the sheet conveyance direction, and a controller to cause the spine formation unit to operate in one of multiple selectable control modes for controlling the spine formation unit in accordance with at least one of multiple predetermined sheet-related variables.

11 Claims, 27 Drawing Sheets

FOREIGN PATENT DOCUMENTS

| | | | |
|---|---|---|---|
| EP | 2 261 156 | | 12/2010 |
| JP | 2001-260564 | A | 9/2001 |
| JP | 2005-298130 | | 10/2005 |
| JP | 2007-237562 | | 9/2007 |
| JP | 2007237562 | A | 9/2007 |
| JP | 2009-202553 | | 9/2009 |

OTHER PUBLICATIONS

Extended search report for corresponding European patent application No. 10251735.6 dated Feb. 3, 2011.

* cited by examiner

FIG. 28

| SHEET THICKNESS: T (g/m²) | T≦80 | 80<T≦128 | 128<T |
|---|---|---|---|
| THICKNESS LEVEL | A | B | C |

FIG. 29

THICKNESS LEVEL A

| NUMBER OF SHEETS | 1-5 | 6-10 | 11-15 | 16-20 |
|---|---|---|---|---|
| SQUEEZING TIME (s) | 1 | 3 | 7 | 12 |

THICKNESS LEVEL B

| NUMBER OF SHEETS | 1-5 | 6-10 | 11-15 | 16-20 |
|---|---|---|---|---|
| SQUEEZING TIME (s) | 2 | 5 | 10 | 15 |

FIG. 30

THICKNESS LEVEL A

| NUMBER OF SHEETS | 1-5 | 6-10 | 11-15 | 16-20 |
|---|---|---|---|---|
| REPEAT NUMBER OF SQUEEZING | 2 | 2 | 3 | 4 |

THICKNESS LEVEL B

| NUMBER OF SHEETS | 1-5 | 6-10 | 11-15 | 16-20 |
|---|---|---|---|---|
| SQUEEZING TIME (s) | 2 | 3 | 4 | 5 |

FIG. 31

IMAGE FORMATION CAPACITY: 130PPM

| NUMBER OF SHEETS | 1-5 | 6-10 | 11-15 | 16-20 |
|---|---|---|---|---|
| SQUEEZING TIME LIMIT | 1 | 3 | 5 | 7 |

IMAGE FORMATION CAPACITY: 90PPM

| NUMBER OF SHEETS | 1-5 | 6-10 | 11-15 | 16-20 |
|---|---|---|---|---|
| SQUEEZING TIME LIMIT | 1.5 | 4.5 | 7.5 | 10.5 |

IMAGE FORMATION CAPACITY: 60PPM

| NUMBER OF SHEETS | 1-5 | 6-10 | 11-15 | 16-20 |
|---|---|---|---|---|
| SQUEEZING TIME LIMIT | 2 | 6 | 10 | 14 |

SPINE FORMATION DEVICE, BOOKBINDING SYSTEM, AND CONTROL METHOD THEREFOR

CROSS-REFERENCE TO RELATED APPLICATIONS

This patent specification is based on and claims priority from Japanese Patent Application No. 2009-250793, filed on Oct. 30, 2009 in the Japan Patent Office, which is hereby incorporated by reference herein in its entirety.

BACKGROUND OF THE INVENTION

1. Field of the Invention

The present invention generally relates to a spine formation device to form a spine of a bundle of folded sheets, a bookbinding system including the spine formation device and an image forming apparatus, such as a copier, a printer, a facsimile machine, or a multifunction machine capable of at least two of these functions, and a method for controlling the spine formation device.

2. Description of the Background Art

At present, saddle-stitching or saddle-stapling, that is, stitching or stapling a bundle of sheets along its centerline is widely used as a simple bookbinding method. Typically, the spine of the bundle of sheets (hereinafter "a booklet") produced through saddle-stitching bookbinding tends to bulge as a result of being folded along its centerline. It is preferred to reduce such bulging of the spine of the booklet, that is, to flatten the spine of the booklet to facilitate stacking, storage, and transport of the booklet.

More specifically, when a bundle of sheets is saddle-stitched or saddle-stapled and then folded in two, the folded portion around its spine tends to bulge, degrading the overall appearance of the booklet. In addition, because the bulging spine makes the booklet thicker on the spine side and thinner on the opposite side, when the booklets are piled together with the bulging spines on the same side, the piled booklets tilt more as the number of the booklets increases. Consequently, the booklets might fall over when piled together.

By contrast, when the spine of the booklet is flattened, bulging of the booklet can be reduced, and accordingly multiple booklets can be piled together. This flattening is important for ease of storage and transport because it is difficult to stack booklets together if their spines bulge, making it difficult to store or carry them. With this reformation, relatively large number of booklets can be piled together. It is to be noted that the term "spine" used herein means not only the stitched side of the booklet but also portions of the front cover and the back cover continuous with the spine.

In view of the foregoing, for example, the following approaches have been proposed to flatten the spine of the booklet.

For example, in JP-2001-260564-A, the spine of the booklet is flattened using a pressing member configured to sandwich an end portion of the booklet adjacent to the spine and a spine-forming roller configured to roll on longitudinally while contacting the spine of the booklet. The spine-forming roller moves at least once over the entire length of the spine of the booklet fixed in place by the pressing member while applying to the spine a pressure sufficient to flatten the spine.

Although this approach can flatten the spine of the booklet to a certain extent, it is possible that the sheets might wrinkle and be torn around the spine or folded portion because the pressure roller applies localized pressure to the spine continuously. Further, it takes longer to flatten the spine because the pressure roller must move over the entire length of the spine of the booklet.

Therefore, for example, in JP-2007-237562-A, the spine of the booklet is flattened using a spine pressing member pressed against the spine of the booklet, a sandwiching member that sandwiches the bundle of folded sheets from the front side and the back side of the booklet, and a pressure member to squeeze the spine from the sides, laterally, in the direction of the thickness of the booklet to reduce bulging of the spine.

However, because only the bulging portion is pressed with the spine-forming roller in the first approach, the booklet can wrinkle in a direction perpendicular to the longitudinal direction in which the spine extends, degrading its appearance. In addition, with larger sheet sizes, productivity decreases because it takes longer for the spine-forming roller to move over the entire length of the spine of the booklet. At present, it is important to operate such spine formation devices efficiently to reduce energy consumption. Generally, when efficiency is considered, processing conditions such as the degree of pressure and the number of repetitions vary depending on the quantity of sheets, sheet thickness, and sheet type. However, in the first approach using the spine-forming roller, only the number of times the spine-forming roller moves the entire length of the spine of the booklet can be adjusted, and thus it is difficult to make processing more efficient.

In addition, although the second approach can reduce the occurrence of wrinkles in and damage to the booklet caused by the first method described above, the processing time can still be relatively long because the sandwiching member, the pressure member, and so forth are all operated consecutively and not simultaneously after the booklet is pressed against the spine pressing plate.

In view of the foregoing, the inventors of the present invention recognize that there is a need to reduce bulging of booklets efficiently while reducing the processing time, energy consumption, and damage to the booklet, which known approaches fail to do.

SUMMARY OF THE INVENTION

In view of the foregoing, an object of the present invention is to enhance efficiency in forming a spine of a bundle of folded sheets.

In one illustrative embodiment of the present invention, a spine formation device for forming a spine of a bundle of folded sheets includes a sheet conveyer that conveys the bundle of folded sheets with a folded portion of the bundle of folded sheets forming a front end portion of the bundle of folded sheets, a spine formation unit disposed downstream from the sheet conveyer in a sheet conveyance direction in which the bundle of folded sheets is transported, a discharge unit to discharge the bundle of folded sheets outside the spine formation device, disposed downstream form the spine formation unit in the sheet conveyance direction, and a controller operatively connected to the spine formation unit. The spine formation unit forms the spine of the bundle of folded sheets by squeezing the folded portion of the bundle from a folded leading side, a front side, and a back side of the bundle. The controller causes the spine formation unit to operate in one of multiple selectable control modes for controlling the spine formation unit in accordance with at least one of multiple predetermined sheet-related variables.

Another illustrative embodiment provides a spine formation system that includes an image forming apparatus, a post-processing apparatus to perform post processing of sheets transported from the image forming apparatus, and the spine formation device described above.

Yet another illustrative embodiment provides a method for controlling the above-described spine formation device. The method includes a step of selecting one of multiple control modes for controlling the spine formation unit in accordance with at least one of multiple predetermined sheet-related variables in the bundle, and a step of operating the spine formation unit in the selected one of multiple control modes.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 28 shows judgment table 1 including mode setting conditions according to sheet thickness;

FIG. 29 shows judgment table 2 including conditions for setting squeezing time according to the mode setting conditions and the quantity of sheets;

FIG. 30 shows judgment table 3 including conditions for setting the number of times squeezing is repeated;

FIG. 31 shows judgment table 4 including conditions for setting squeezing time limit for each number of sheets;

DETAILED DESCRIPTION OF PREFERRED EMBODIMENTS

Figure 1:
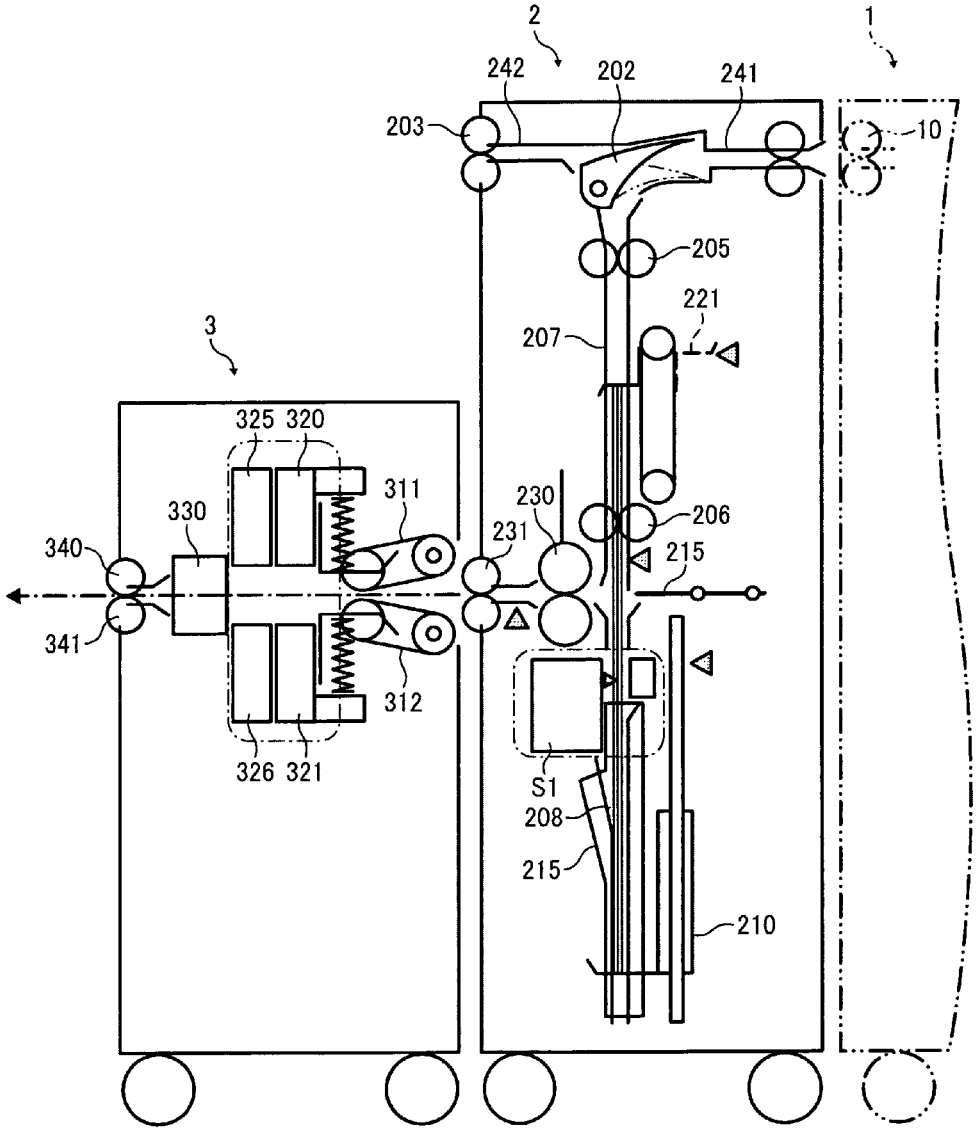
FIG. 1 illustrates a bookbinding system including an image forming apparatus, a post-processing apparatus and a spine formation device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a bookbinding system according to an illustrative embodiment of the present invention is described.

In the embodiments of the present invention, the spine and the portions on the front side and the back side adjacent to the spine are pressed and flattened so that the front side and the back side are perpendicular or substantially perpendicular to the spine, forming a square spine portion. Flattening the spine of the booklets allows a relatively large number of booklets to be piled together with ease and makes it easier to store or transport them. To shape the spine, a spine formation device according to illustrative embodiments of the present invention includes a conveyance unit, an auxiliary sandwiching unit, a sandwiching unit, and a contact member disposed in that order in a direction in which a bundle of folded sheets is transported (hereinafter "booklet conveyance direction"). The gap between the counterparts in the pair of guide plates, the pair of auxiliary sandwiching plates, and pair of the sandwiching unit is reduced gradually in that order, that is, from the upstream side in the sheet conveyance direction, thereby localizing the bulging of the booklet to the downstream side. Then, the sandwiching units squeeze the bundle of sheets while a leading edge of the bundle is pressed against the contact member. Thus, the bundle of sheets is shaped into a lateral U-shape.

Meanwhile, conditions of spine formation, namely, the strength of pressure squeezing the bundle of sheets, time of squeezing, and the number of squeezing operation, differ depending on the sheet-related variables, that is, the characteristics of the sheets forming the bundle (hereinafter "booklet"). In other words, the degree of pressure is proportional to the quantity of sheets. Additionally, even when the thickness is similar or identical, it is more difficult to bend a bundle of thicker sheets than a bundle of thinner sheets. Further, because sheets are med of fibers, is easier to bend sheets in a direction parallel to the direction of fibers than in a direction perpendicular to the direction of fibers. Therefore, waste of power (electricity) can be avoided by adjusting the conditions of spine formation based on such characteristics of sheets (i.e., sheet characteristic data). With this configuration, the spine formation system according to the illustrative embodiments of the present invention can be effective in reducing energy consumption effective and increase process speed, thus enhancing time efficiency, simultaneously.

An illustrative embodiment is described below with reference to FIG. 1.

FIG. 1 illustrates a bookbinding system including a post-processing apparatus 1, a bookbinding device 2, and a spine formation device 3 according to an illustrative embodiment of the present invention.

Figure 19:
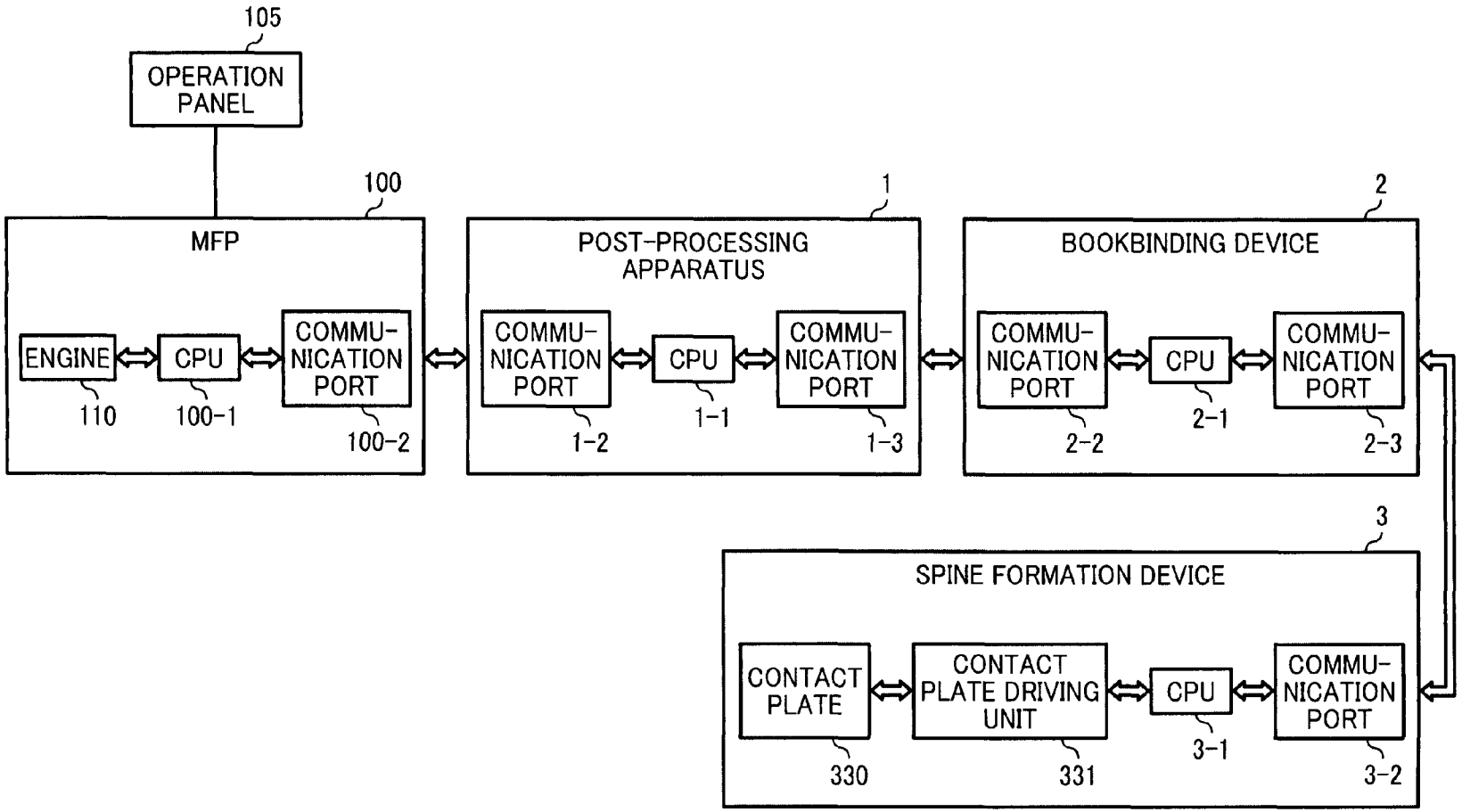
FIG. 19 is a block diagram illustrating a configuration of online control of the bookbinding system.

When connected to an image forming apparatus 100, which is shown as a multifunction peripheral (MFP) 100 in FIG. 19, this system functions as a bookbinding system that can perform image formation to bookbinding inline or online.

In this system, the bookbinding device 2 performs saddle-stitching or saddle-stapling, that is, stitches or staples, along its centerline, a bundle of sheets discharged thereto by a pair of discharge rollers 10 from the post-processing apparatus 1 and then folds the bundle of sheets along the centerline, after which a pair of discharge rollers 231 transports the bundle of folded sheets (booklet) to the spine formation device 3. Then, the spine formation device 3 flattens the folded portion of the booklet and discharges it outside the spine formation device 3. The image forming apparatus (MFP) 100 shown in FIG. 19 may be a copier, a printer, a facsimile machine, or a digital multifunction machine including at least two of those functions that forms images on sheets of recording media based on image data input by users or read by an image reading unit. The MFP 100 includes a printer engine for forming images and a scanner engine for reading images, together forming an engine 110 shown in FIG. 19. The spine formation device 3 includes transport belts 311 and 312, auxiliary sandwiching plates 320 and 321, sandwiching plates 325 and 326, a contact plate 330, and a pair of discharge rollers 340 and 341 disposed in that order in the sheet conveyance direction.

Figure 2:
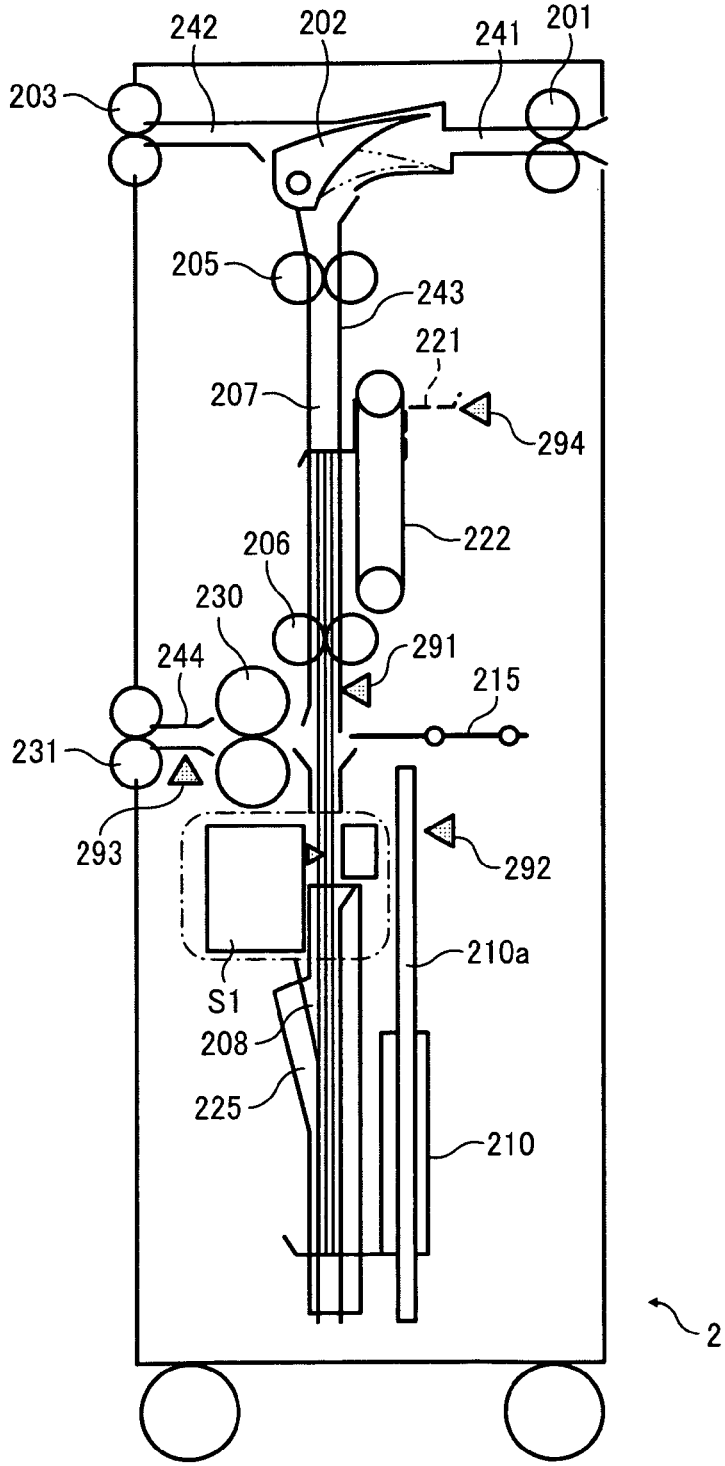
FIG. 2 is a front view illustrating a configuration of the post-processing apparatus shown in FIG. 1.

Referring to FIGS. 1 and 2, a configuration of the bookbinding device 2 is described below.

FIG. 2 illustrates a configuration of the bookbinding device 2.

Referring to FIG. 2, an entrance path 241, a sheet path 242, and a center-folding path 243 are formed in the bookbinding device 2. A pair of entrance rollers 201 provided extreme upstream in the entrance path 241 in the sheet conveyance direction receives a bundle of aligned sheets transported by the discharge rollers 10 of the post-processing apparatus 1. It is to be noted that hereinafter "upstream" and "downstream" refer to those in the sheet conveyance direction unless otherwise specified.

A separation pawl 202 is provided downstream from the entrance rollers 201 in the entrance path 241. The separation pawl 202 extends horizontally in FIG. 2 and switches the sheet conveyance direction between a direction toward the sheet path 242 and that toward the center-folding path 243. The sheet path 242 extends horizontally from the entrance path 241 and guides the bundle of sheets to a downstream device or a discharge tray, not shown, and a pair of upper discharge rollers 203 discharges the bundle of sheets from the sheet path 242. The center-folding path 243 extends vertically in FIGS. 1 and 2 from the separation pawl 202, and the bundle of sheets is transported along the folding path 243 when at least one of stapling and folding is performed.

Along the center-folding path 243, an upper sheet guide 207 and a lower sheet guide 208 to guide the bundle of sheets are provided above and beneath a folding plate 215, respectively, and the folding plate 215 is used to fold the bundle of sheets along its centerline. A pair of upper transport rollers 205, a trailing-edge alignment pawl 221, and a pair of lower transport rollers 206 are provided along the upper sheet guide 207 in that order from the top in FIG. 2. The trailing-edge alignment pawl 221 is attached to a pawl driving belt 222 driven by a driving motor, not shown, and extends perpendicularly to a surface of the driving belt 222. As the pawl driving belt 222 rotates opposite directions alternately, the trailing-edge alignment pawl 221 pushes a trailing-edge of the bundle of sheets toward a movable fence 210 disposed in a lower portion in FIG. 2, thus aligning the bundle of sheets. Additionally, as indicated by broken lines shown in FIG. 2, the trailing-edge pawl 221 moves away from the upper sheet guide 207 provided along the center-folding path 243 when the bundle of sheets enters the center-folding path 243 and when the bundle of sheets ascends to be folded. In FIG. 2, reference numeral 294 represents a pawl home position (HP) detector that detects the trailing-edge alignment pawl 221 at a home position indicated by the broken lines shown in FIG. 2. The trailing-edge alignment pawl 221 is controlled with reference to the home position.

A saddle stapler S1, a pair of jogger fences 225, and the movable fence 210 are provided along the lower sheet guide 208 in that order from the top in FIG. 2. The lower sheet guide 208 receives the bundle of sheets guided by the upper sheet guide 207, and the pair of jogger fences 225 extends in a sheet width direction perpendicular to the sheet conveyance direction. The movable fence 210 positioned beneath the lower sheet guide 208 moves vertically, and a leading edge of the bundle of sheets contacts the movable fence 210.

The saddle stapler S1 staples the bundle of sheets along its centerline. While supporting the leading edge of the bundle of sheets, the movable fence 210 moves vertically, thus positioning a center portion of the bundle of sheets at a position facing the saddle stapler S1, where saddle stapling is performed. The movable fence 210 is supported by a fence driving mechanism 210*a* and can move from the position of a fence HP detector 292 disposed above the stapler S1 to a bottom position in the post-processing apparatus 2 in FIG. 2. A movable range of the movable fence 210 that contacts the leading edge of the bundle of sheets is set so that strokes of the movable fence 210 can align sheets of any size processed by the bookbinding device 2. It is to be noted that, for example, a rack-and-pinion may be used as the fence driving mechanism 210*a*.

The folding plate 215, a pair of folding rollers 230, and a discharge path 244, and the pair of lower discharge rollers 231 are provided horizontally between the upper sheet guide 207 and the lower sheet guide 208, that is, in a center portion of the enter-folding path 243 in FIG. 2. The folding plate 215 can move reciprocally back and forth horizontally in FIG. 2 in the folding operation, and the folding plate 215 is aligned with a position where the folding rollers 230 press against each other (hereinafter "nip") in that direction. The discharge path 244 is positioned also on an extension line from the line connecting them. The lower discharge rollers 231 are disposed extreme downstream in the discharge path 244 and discharge the bundle of folded sheets to a subsequent stage.

Additionally, a sheet detector 291 provided on a lower side of the upper sheet guide 207 in FIG. 2 detects the leading edge of the bundle of sheets that passes a position facing the folding plate 215*a* (hereinafter "folding position") in the center-folding path 243. Further, a folded portion detector 293 provided along the discharge path 224 detects the folded leading-edge portion (hereinafter simply "folded portion") of the bundle of folded sheets, thereby recognizes the passage of the bundle of folded sheets.

Saddle-stapling and center-holding performed by the bookbinding device 2 shown in FIG. 2 are described briefly below with reference to FIGS. 3 through 7. When a user selects saddle-stapling and center-folding via an operation panel 105 (shown in FIG. 19) of the image forming apparatus 100 (shown in FIG. 19), the separation pawl 202 pivots counterclockwise in FIG. 2, thereby guiding the bundle of sheets to be stapled and folded to the center-folding path 243. The separation pawl 201 is driven by a solenoid, not shown. Alternatively, the separation pawl 201 may be driven by a motor.

Figure 3:
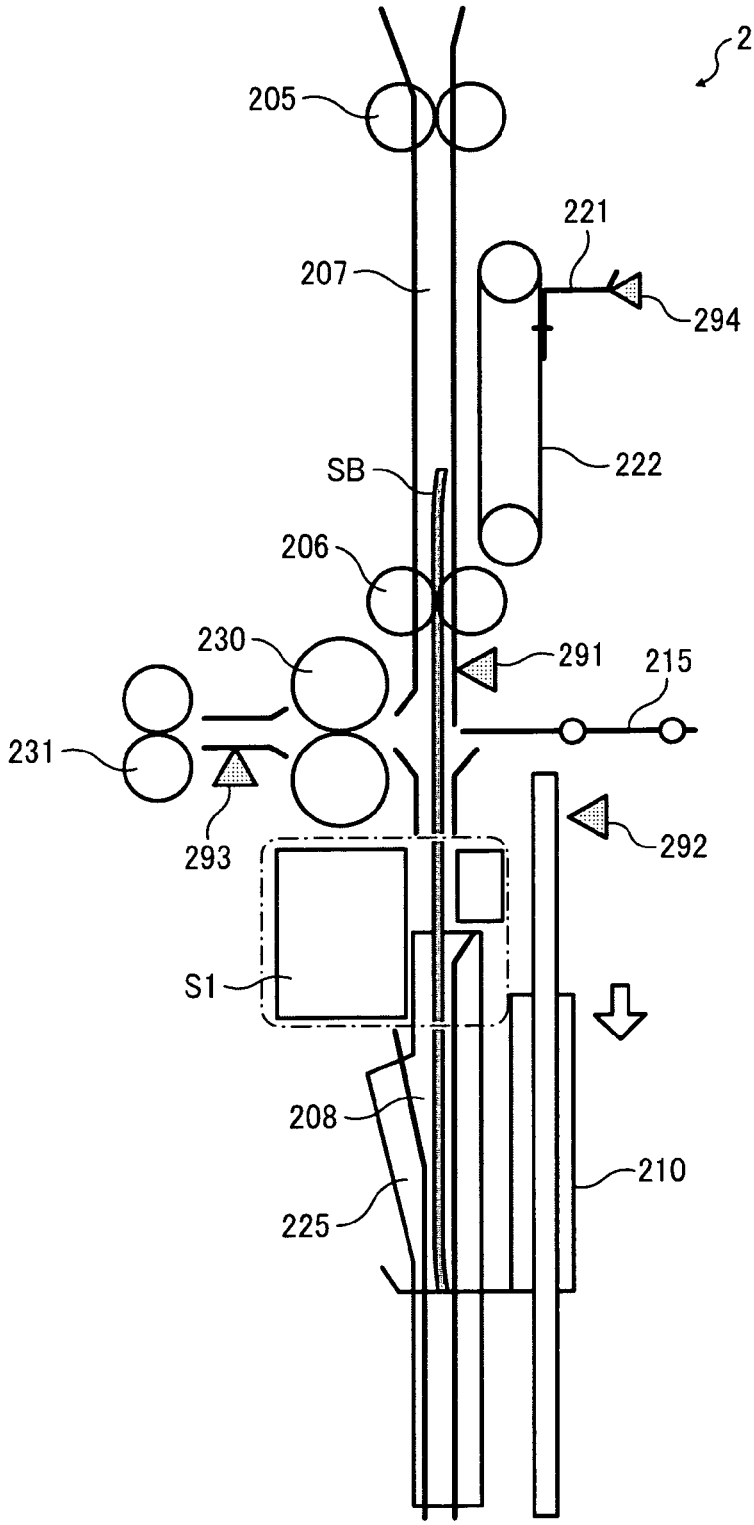
FIG. 3 illustrates the post-processing apparatus in which a bundle of sheets is transported.

A bundle of sheets SB transported to the center-folding path 243 is transported by pair of entrance rollers 201 and the pair of upper transport rollers 205 downward in the center-folding path 243 in FIG. 3. After the sheet detector 291 detects the passage of the bundle of sheets SB, the lower transport rollers 206 transport the bundle of sheets SB until the leading edge of the bundle of sheets SB contacts the movable fence 210 as shown in FIG. 3. At that time, the movable fence 210 is at a standby position varied in the vertical direction shown in FIG. 3 according to size data of the bundle of sheets SB, which in this operation is size data in the sheet conveyance direction, transmitted from the image forming apparatus 100 shown in FIG. 19. Simultaneously, the lower transport rollers 206 sandwich the bundle of sheets SB therebetween, and the trailing-edge alignment pawl 221 is at the home position.

Figure 4:
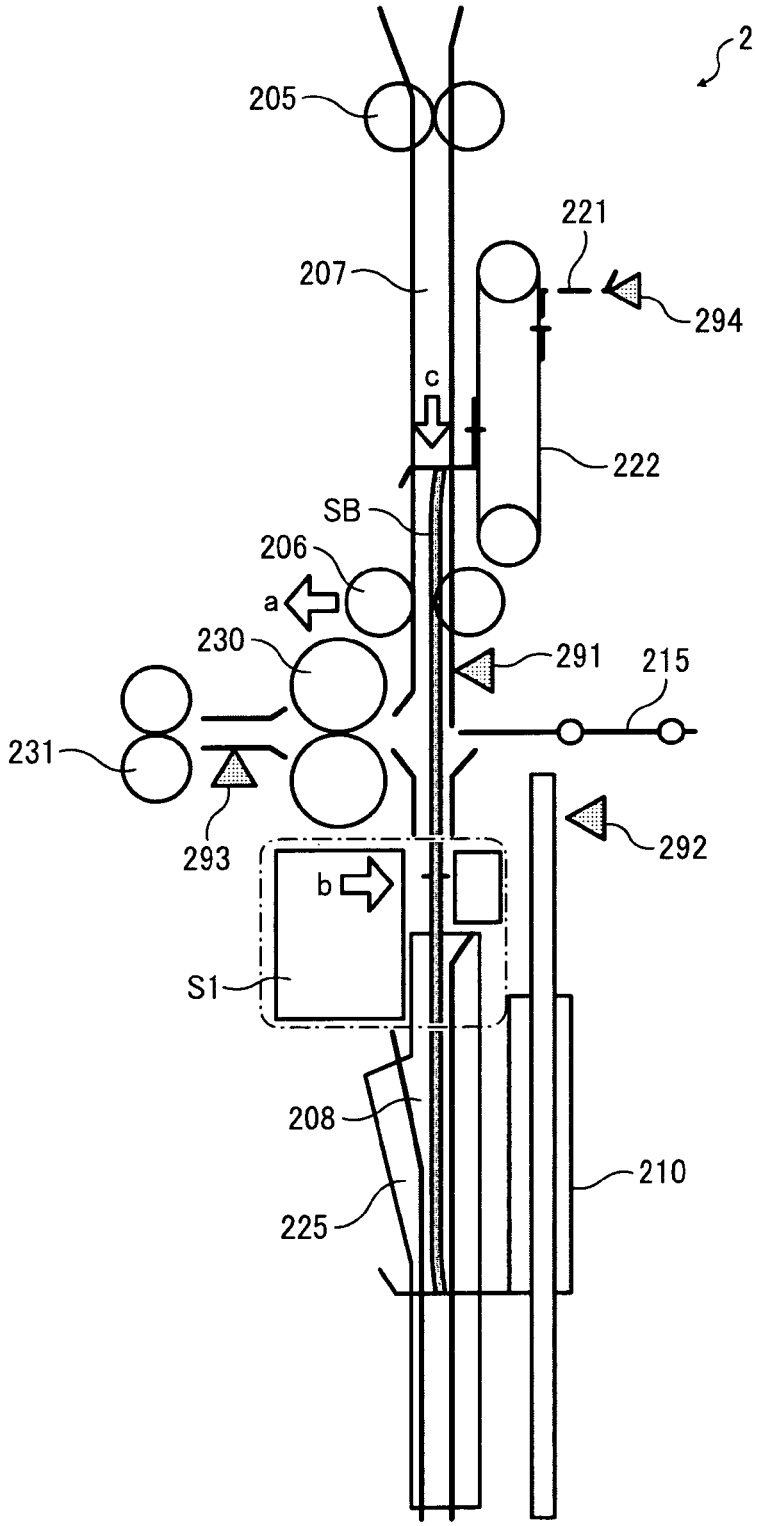
FIG. 4 illustrates the post-processing apparatus in which the bundle of sheets is stapled along the centerline.

When the pair of lower transport rollers 206 is moved away from each other as indicated by arrow a shown in FIG. 4, releasing the trailing edge of the bundle of sheets SB whose leading edge is in contact with the movable fence 210, the trailing-edge alignment pawl 221 is driven to push the trailing edge of the bundle of sheets SB, thus completing alignment of the bundle of sheets SB in the sheet conveyance direction as indicated by arrow c shown in FIG. 4.

Subsequently, the bundle of sheets SB is aligned in the sheet width direction perpendicular to the sheet conveyance direction by the pair of jogger fences 225, and thus alignment of the bundle of sheets SB in both the sheet width direction and the sheet conveyance direction is completed. At that time, the amounts by which the trailing-edge alignment pawl 221 and the pair of jogger fences 225 push the bundle of sheets SB to align it are set to optimum values according to the size data (sheet size data) of the bundle of sheets including the quantity of sheets and the thickness of the bundle. It is to be noted that, in addition to the sheet size data including the quantity of sheets and the thickness of the bundle, special sheet classification that indicates that the bundle is formed with special type of sheets is used in setting mode described later.

It is to be noted that, when the bundle of sheets SB is relatively thick, it occupies a larger area in the center-folding path 243 with the remaining space therein reduced, and accordingly a single alignment operation is often insufficient to align it. Therefore, the number of alignment operations is increased in that case. Thus, the bundle of sheets SB can be aligned fully. Additionally, as the quantity of sheets increases, it takes longer to stack multiple sheets one on another upstream from the post-processing apparatus 2, and accordingly it takes longer before the post-processing apparatus 2 receives a subsequent bundle of sheets. Consequently, the increase in the number of alignment operations does not cause a loss time in the sheet processing system, and thus efficient and reliable alignment can be attained. Therefore, the number of alignment operations may be adjusted according to the time required for the upstream processing.

It is to be noted that the standby position of the movable fence 210 is typically positioned facing the saddle-stapling position of the bundle of sheets SB or the stapling position of the saddle stapler S1. When aligned at that position, the bundle of sheets SB can be stapled at that position without moving the movable fence 210 to the saddle-stapling position of bundle of sheets SB. Therefore, at that standby position, a stitcher, not shown, of the saddle stapler S1 is driven in a direction indicated by arrow b shown in FIG. 4, and thus the bundle of sheets SB is stapled between the stitcher and a clincher, not shown, of the saddle stapler S1.

It is to be noted that the positions of the movable fence 210 and the trailing-edge alignment pawl 221 are controlled with pulses of the fence HP detector 292 and the pawl HP detector 294, respectively. Positioning of the movable fence 210 and the trailing-edge alignment pawl 221 is performed by a central processing unit (CPU) 2-1 (shown in FIG. 19) of the bookbinding device 2.

Figure 5:
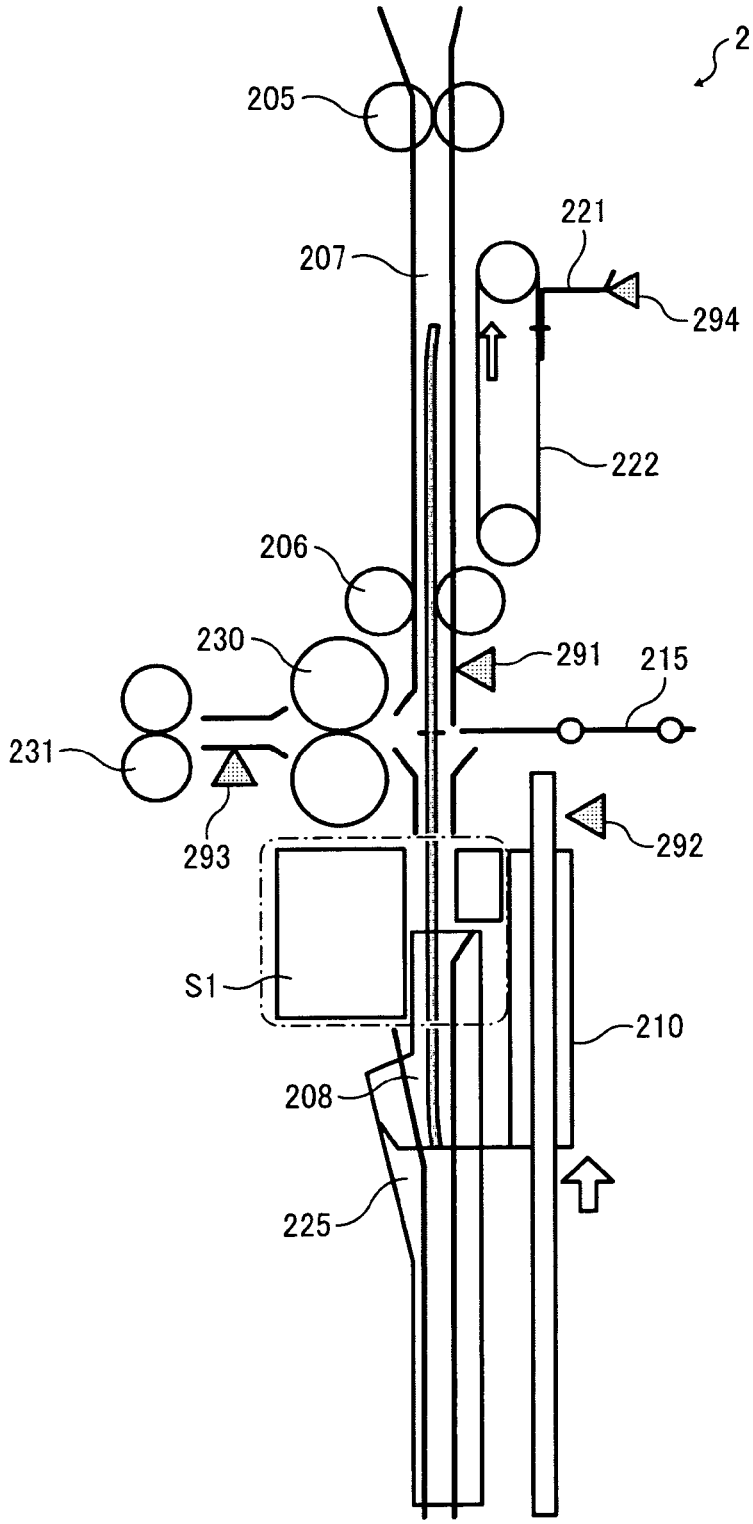
FIG. 5 illustrates the post-processing apparatus in which the bundle of sheets is set at a center-folding position.

After stapled along the centerline in the state shown in FIG. 4, the bundle of sheets SB is lifted to a position where the saddle-stapling position thereof faces the folding plate 215 as the movable fence 210 moves upward as shown in FIG. 5 while the pair of lower transport rollers 206 does not press against the bundle of sheets SB. This position is adjusted with reference to the position detected by the fence HP detector 292.

Figure 6:
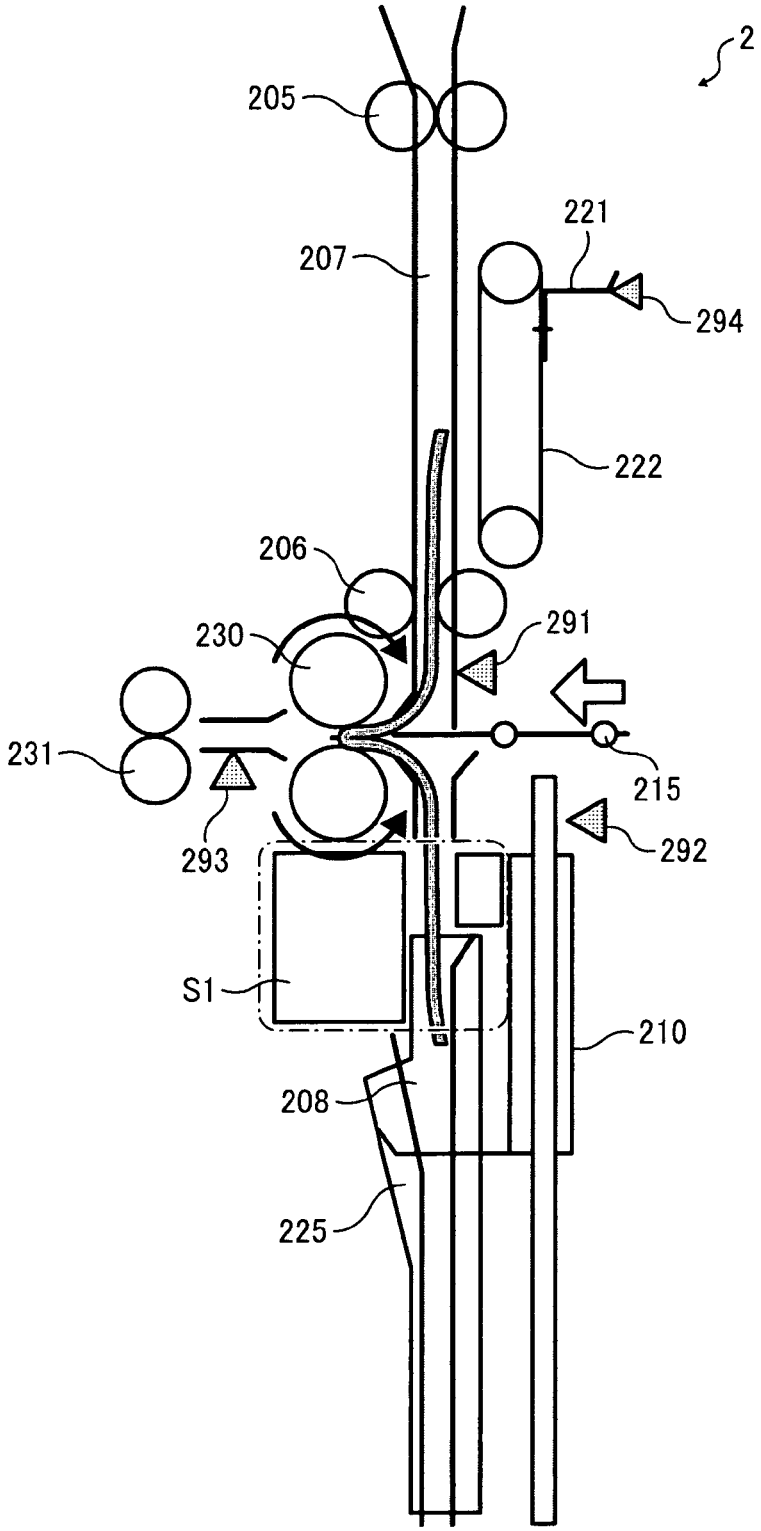
FIG. 6 illustrates the post-processing apparatus in which the bundle of sheets is being folded in two.
Figure 7:
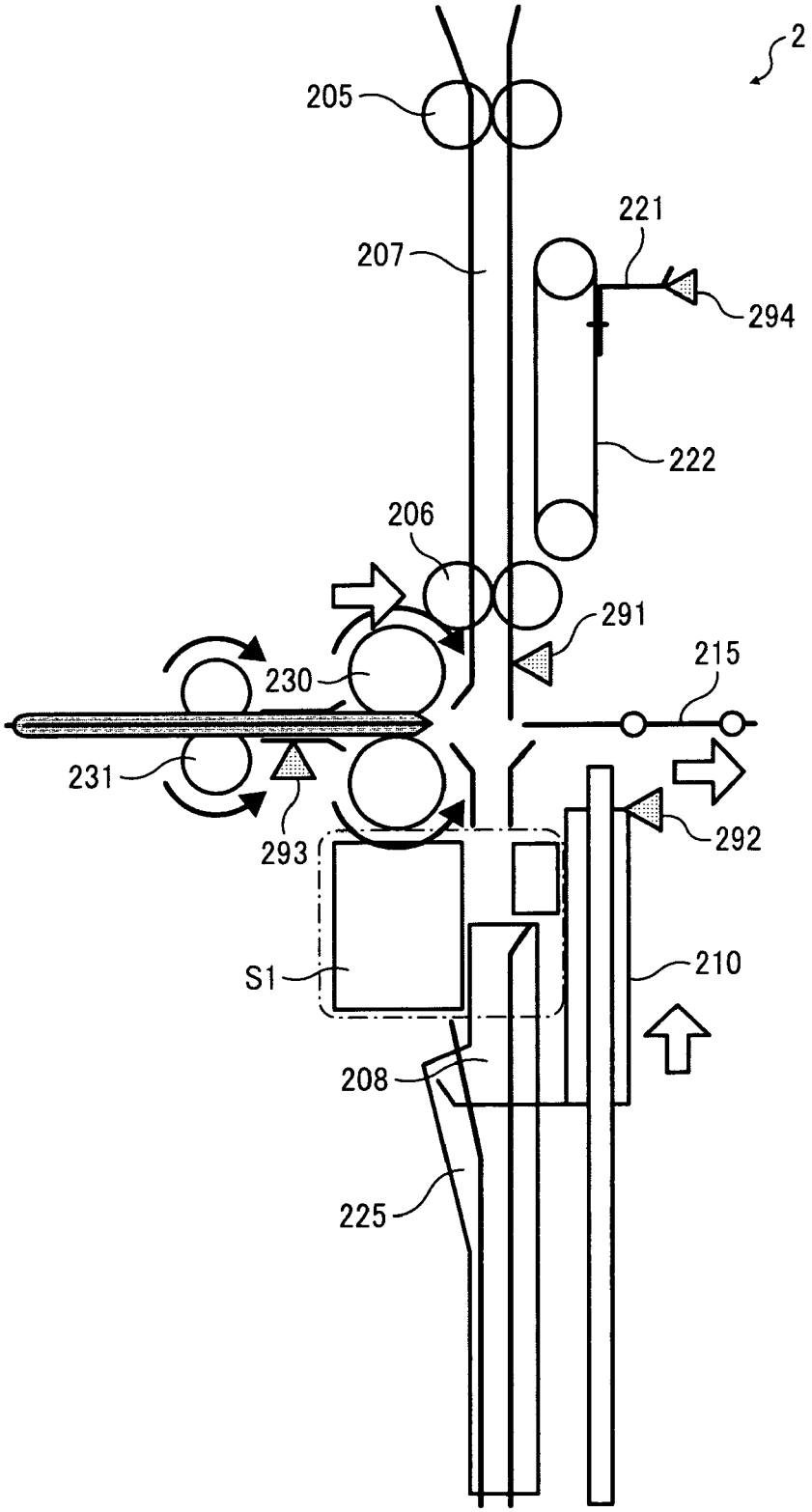
FIG. 7 illustrates the post-processing apparatus from which the bundle of folded sheets is discharged.

When the bundle of sheets SB is set at the position shown in FIG. 5, the folding plate 215 approaches the nip between the pair of folding rollers 230 as shown in FIG. 6 and pushes toward the nip the bundle of sheets SB in a portion around the staples binding the bundle in a direction perpendicular or substantially perpendicular to a surface of the bundle of sheets SB. Thus, the bundle of sheets SB pushed by the folding plate 215 is folded in two and sandwiched between the pair of folding roller 230 being rotating. While squeezing the bundle of sheets SB caught in the nip, the pair of folding roller 230 transports the bundle of sheets SB. Thus, while squeezed and transported by the folding rollers 230, the bundle of sheets SB is center-folded as a booklet SB. FIG. 6 illustrates a state in which a folded leading edge of the booklet SB is squeezed in the nip between the folding rollers 230.

After folded in two as shown in FIG. 6, the booklet SB is transported by the folding rollers 230 downstream and then discharged by the discharged rollers 231 to a subsequent stage. When the folded portion detector 293 detects a trailing edge portion of the booklet SB, both the folding plate 215 and the movable fence 210 return to the respective home positions. Then, the lower transport rollers 206 move to press against each other as a preparation for receiving a subsequent bundle of sheets. Further, if the number and the size of sheets forming the subsequent bundle are similar to those of the previous bundle of sheets, the movable fence 210 can wait again at the position shown in FIG. 3. The above-described control is performed also by the CPU 2-1 of the control circuit shown in FIG. 19.

Figure 8:
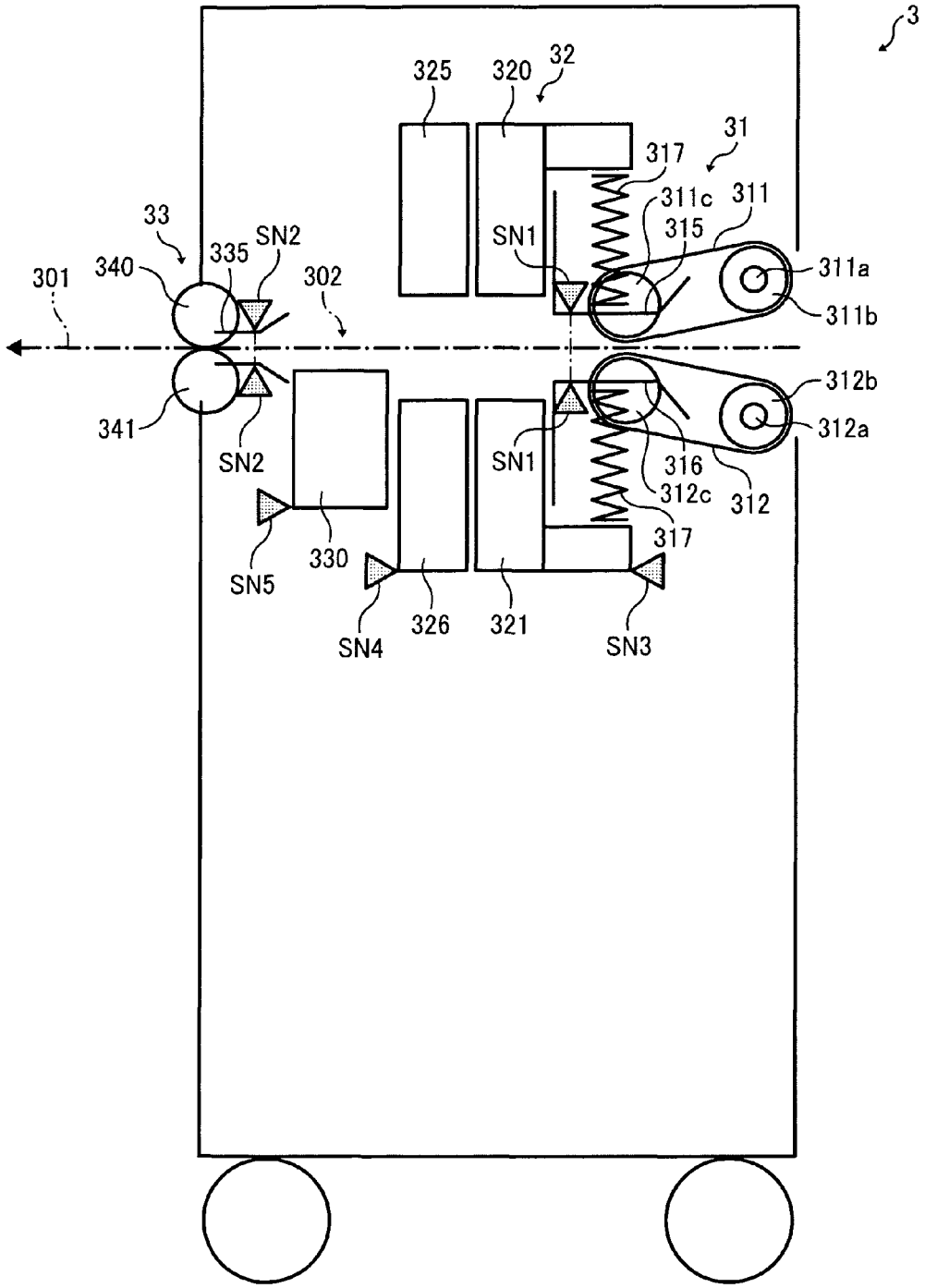
FIG. 8 is a front view illustrating a configuration of the spine formation devices shown in FIG. 1.

FIG. 8 is a front view illustrating a configuration of the spine formation device 3 shown in FIG. 1. Referring to FIG. 8, the spine formation device 3 includes a conveyance unit 31, an auxiliary sandwiching unit 32, a sandwiching unit (i.e., sandwiching plates 325 and 326), a contact member, and a discharge unit 33. It is to be noted that, in this specification, the booklet means the bundle of sheets that is folded and stapled along its centerline and is different from unbound sheets S.

The conveyance unit 31 includes the vertically-arranged transport belts 311 and 312, and the auxiliary sandwiching unit 32 includes vertically-arranged guide plates 315 and 316 and the auxiliary sandwiching plates 320 and 321. The contact plate 330 serves as the contact member, and the discharge unit 33 includes the discharge guide plate 335 and the pair of discharge rollers 340 and 341. It is to be noted that, the lengths of the above-described components are greater than the width of the booklet SB in a direction perpendicular to the surface of paper on which FIG. 8 is drawn. The auxiliary sandwiching unit 32, the sandwiching plates 325 and 326, and the contact plate 330 together form a spine formation unit.

Figure 9A:
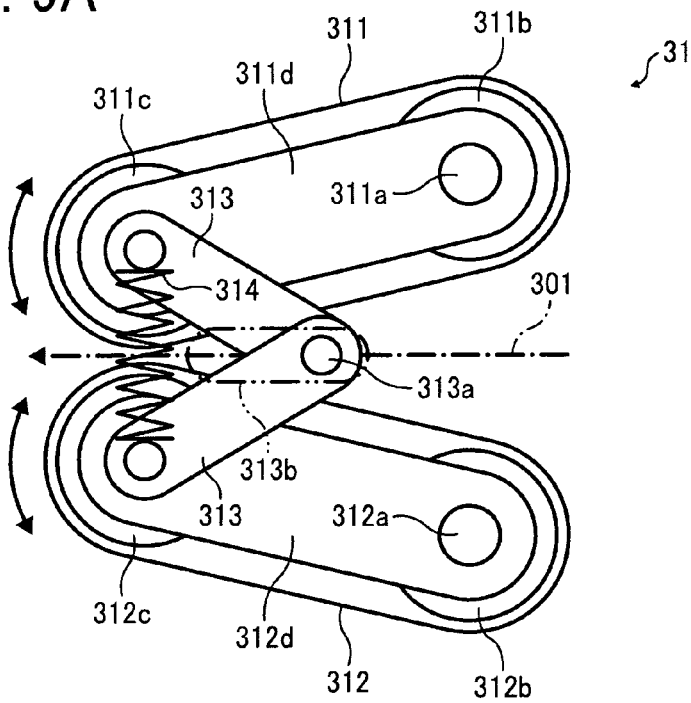
FIG. 9A illustrates an initial state of a transport unit of the spine formation device shown in FIG. 8 to transport a bundle of folded sheets.
Figure 9B:
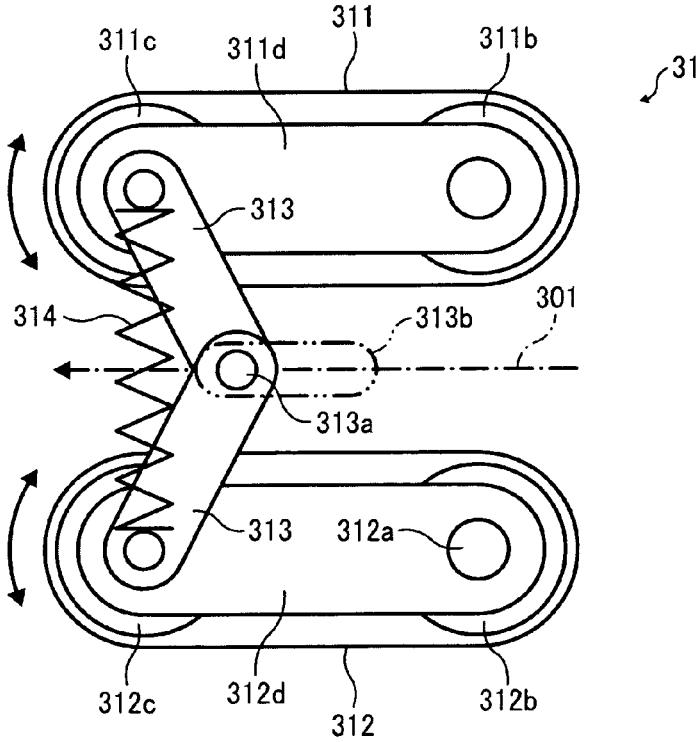
FIG. 9B illustrates a state of the transport unit shown in FIG. 9A in which the bundle of folded sheets is transported.

The transport belts 311 and 312 are disposed on both sides of (in FIG. 8, above and beneath) a transport centerline 301 of a transport path 302, aligned with the line extended from the line connecting the folding plate 215, the nip between the folding rollers 230, and the nip between the discharge rollers 231. The upper transport belt 311 and the lower transport belt 312 are respectively stretched around driving pulleys 311*b* and 312*b* supported by swing shafts 311*a* and 312*a* and driven pulleys 311*c* and 312*c* that are disposed downstream from the driving pulleys 311*b* and 312*b* and face each other across the transport centerline 301. A driving motor, not shown, drives the transport belts 311 and 312. The swing shafts 311*a* and 312*a* respectively support the transport belts 311 and 312 swingably so that the gap between the driven pulleys 311*c* and 312*c* is adjusted corresponding to the thickness of the bundle of sheets. FIGS. 9A and 9B illustrate an initial state of the spine formation device 3 and a state in which the booklet SB is transported therein, respectively.

As shown in FIGS. 9A and 9B, the driving pulleys 311*b* and 312*b* are connected to the driven pulleys 311*c* and 312*c* with support plates 311*d* and 312*d*, respectively, and the transport belts 311 and 312 are respectively stretched around the driving pulleys 311*b* and 312*b* and the driven pulleys 311*c* and 312*c*. With this configuration, the transport belts 311 and 312 are driven by the driving pulleys 311*b* and 312*b*, respectively.

By contrast, rotary shafts of the driven pulleys 311*c* and 312*c* are connected by a link 313 formed with two members connected movably with a connection shaft 313*a*, and a pressure spring 314 biases the driven pulleys 311*c* and 312*c* to approach each other. The connection shaft 313*a* engages a slot 313*b* extending in the sheet conveyance direction, formed in a housing of the spine formation device 3 and can move along the slot 313*b*. With this configuration, as the two members forming the link 313 attached to the driven pulleys 311*c* and 312*c* move, the connection shaft 313*a* moves along the slot 313*b*, thus changing the distance between the driven pulleys 311*c* and 312*c* corresponding to the thickness of the booklet SB while maintaining a predetermined or given pressure in a nip where the transport belts 311 and 312 press against each other.

Additionally, a rack-and-pinion mechanism can be used to move the connection shaft 313*a* along the slot 313*b*, and the position of the connection shaft 313*a* can be set by controlling a motor driving the pinion. With this configuration, when the booklet SB is relatively thick, the distance between the driven pulleys 311*c* and 312*c* (hereinafter "transport gap E can be increased to receive the booklet SB, thus reducing the pressure applied to the folded portion (folded leading-edge portion) of the booklet SB by the transport belts 311 and 312 on the side of the driven pulleys 311*c* and 312*c*. It is to be noted that, when power supply to the driving motor is stopped after the folded portion of the booklet SB is sandwiched between the transport belts 311 and 312, the driven pulleys 311*c* and 312*c* can transport the booklet SB sandwiched therebetween with only the elastic bias force of the pressure spring 314.

Figure 10A:
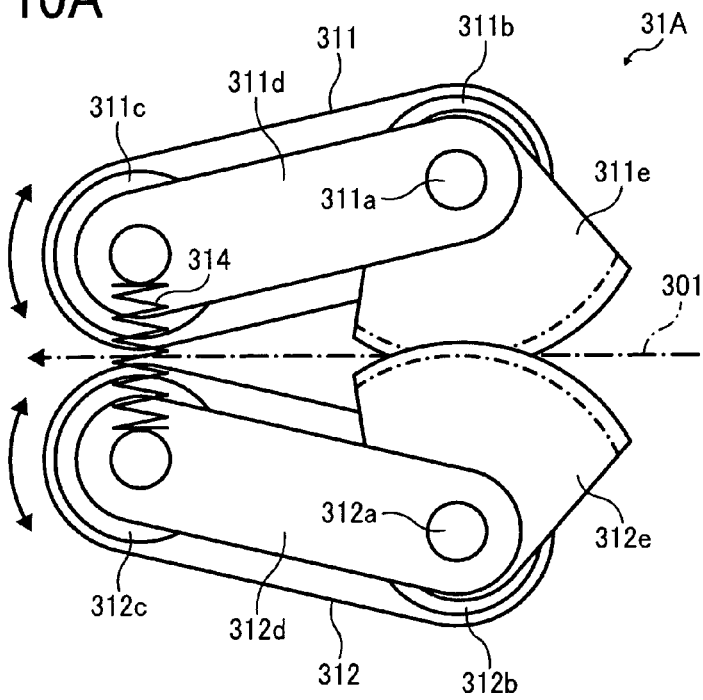
FIGS. 10A and 10B are diagrams of another configuration of the transport unit illustrating an initial state and a state in which the bundle of folded sheets is transported, respectively.
Figure 10B:
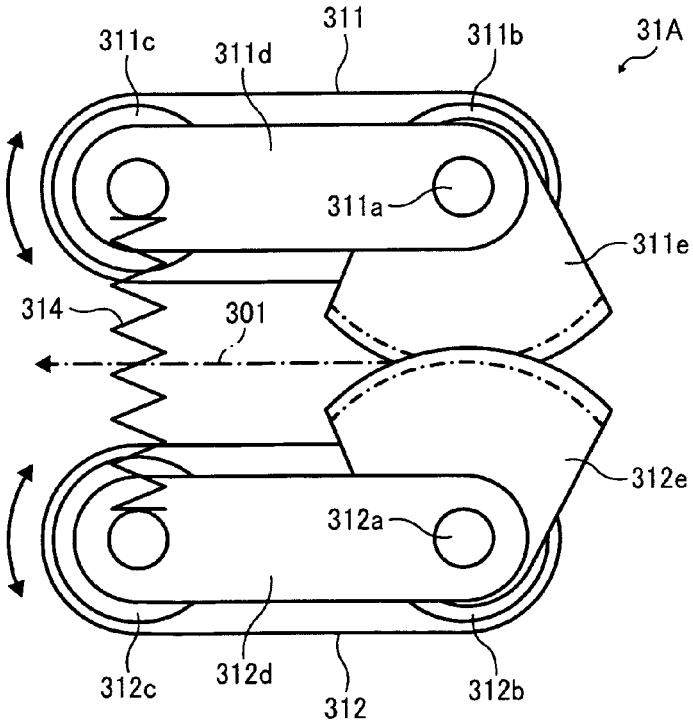

FIGS. 10A and 10B illustrate a conveyance unit 31A in which, instead of using the link 314, the swing shafts 311*a* and 312*a* engage sector gears 311*e* and 312*e*, respectively, and the sector gears 311*e* and 312*e* engaging each other cause the driven pulleys 311*c* and 312*c* to move away from the transport centerline 301 symmetrically. FIGS. 10A and 10B illustrate an initial state of the conveyance unit 31A and a state in which the booklet SB is transported therein, respectively. Also in this configuration, the size of the transport gap to receive the booklet SB can be adjusted by driving one of the sector gears 311*e* and 312*e* with a driving motor including a decelerator similarly to the configuration shown in FIGS. 9A and 9B.

As shown in FIG. 8, the guide plates 315 and 316 are arranged symmetrically on both sides of the transport centerline 301, adjacent to the driven pulleys 311*c* and 312*c*, respectively. The guide plates 315 and 316 respectively include flat surfaces facing the transport path 302, extending from the transport nip to a position adjacent to the auxiliary sandwiching plates 320 and 321, and the flat surfaces serve as transport surfaces. The upper guide plate 315 and the lower guide plate 316 are attached to the upper auxiliary sandwiching plate 320 and the lower auxiliary sandwiching plate 321 with pressure springs 317, respectively, biased to the transport centerline 301 elastically by the respective pressure springs 317, and can move vertically. Further, the auxiliary sandwiching plates 320 and 321 are held by a housing of the spine formation device 3 movably in the vertical direction in FIG. 8. It is to be noted that, alternatively, the guide plates 315 and 316 may be omitted, and the booklet SB may be guided by only surfaces of the auxiliary sandwiching plates 320 and 321 facing the booklet SB.

The vertically-arranged auxiliary sandwiching plates 320 and 321 of the auxiliary sandwiching unit 32 approach and move away from each other symmetrically relative to the transport centerline 301 similarly to the transport belts 311 and 312. A driving mechanism, not shown, provided in the auxiliary sandwiching unit 32 to cause this movement can use the link mechanism used in the conveyance unit 31 or the connection mechanism using the rack and the sector gear shown FIGS. 10A and 10B.

A reference position used in detecting a displacement of the auxiliary sandwiching plates 320 and 321 can be set with the output from the auxiliary sandwiching plate HP detector SN3. Because the vertically-arranged auxiliary sandwiching plates 320 and 321 and the driving unit, not shown, are connected with a spring similar to the pressure spring 314 in the conveyance unit 31, or the like, when the booklet SB is sandwiched by the auxiliary sandwiching plates 320 and 321, damage to the driving mechanism caused by overload can be prevented. The surfaces of the auxiliary sandwiching plates 320 and 321 (e.g., pressure sandwiching surfaces) that sandwich the booklet SB are flat surfaces in parallel to the transport centerline 301.

The vertically-arranged sandwiching plates 325 and 326, serving as the sandwiching unit, approach and move away from each other symmetrically with respect to the transport centerline 301 similarly to the transport belts 311 and 312. A driving mechanism to cause the sandwiching plates 325 and 326 this movement can use the link mechanism used in the conveyance unit 31 or the connection mechanism using the rack and the sector gear shown FIGS. 10A and 10B. A reference position used in detecting a displacement of the sandwiching plates 325 and 326 can be set with the output from the sandwiching plate HP detector SN4. Other than the description above, the sandwiching plates 325 and 326 have configurations similar the auxiliary sandwiching plates 320 and 321 and operate similarly thereto, and thus descriptions thereof are omitted. It is to be noted that a driving source such as a driving motor is requisite in the auxiliary sandwiching unit 32 and the sandwiching unit although it is not requisite in the conveyance unit 31, and the driving source enables the movement between a position to sandwich the booklet and a standby position away form the booklet. The surfaces of the auxiliary sandwiching plates 325 and 326 (e.g., pressure sandwiching surfaces) that sandwich the booklet are flat surfaces in parallel to the transport centerline 301 similarly to the auxiliary sandwiching plates 320 and 321.

The contact plate 330 is disposed downstream from the sandwiching plates 325 and 326. The contact plate 330 and a mechanism, not shown, to move the contact plate 330 vertically in FIG. 8 together form a contact unit. The contact plate 330 moves vertically in FIG. 8 to obstruct the transport path 302 and away from the transport path 302, and a reference position used in detecting a displacement of the contact plate 330 can be set with the output from the contact plate HP detector SN5. When the contact plate 330 is away from the transport path 302, a top surface of the contact plate 330 serves as a transport guide for the booklet SB. Therefore, the top surface of the contact plate 330 is flat, in parallel to the sheet conveyance direction, that is, the transport centerline 301. For example, although not shown in the drawings, the mechanism to move the contact plate 330 can include rack-and-pinions provided on both sides of the contact plate 330, that is, a front side and a back side of the spine formation device 3, and a driving motor to drive the pinions. With this configuration, the contact plate 330 can be moved vertically and set at a predetermined position by driving the driving motor.

Figure 18:
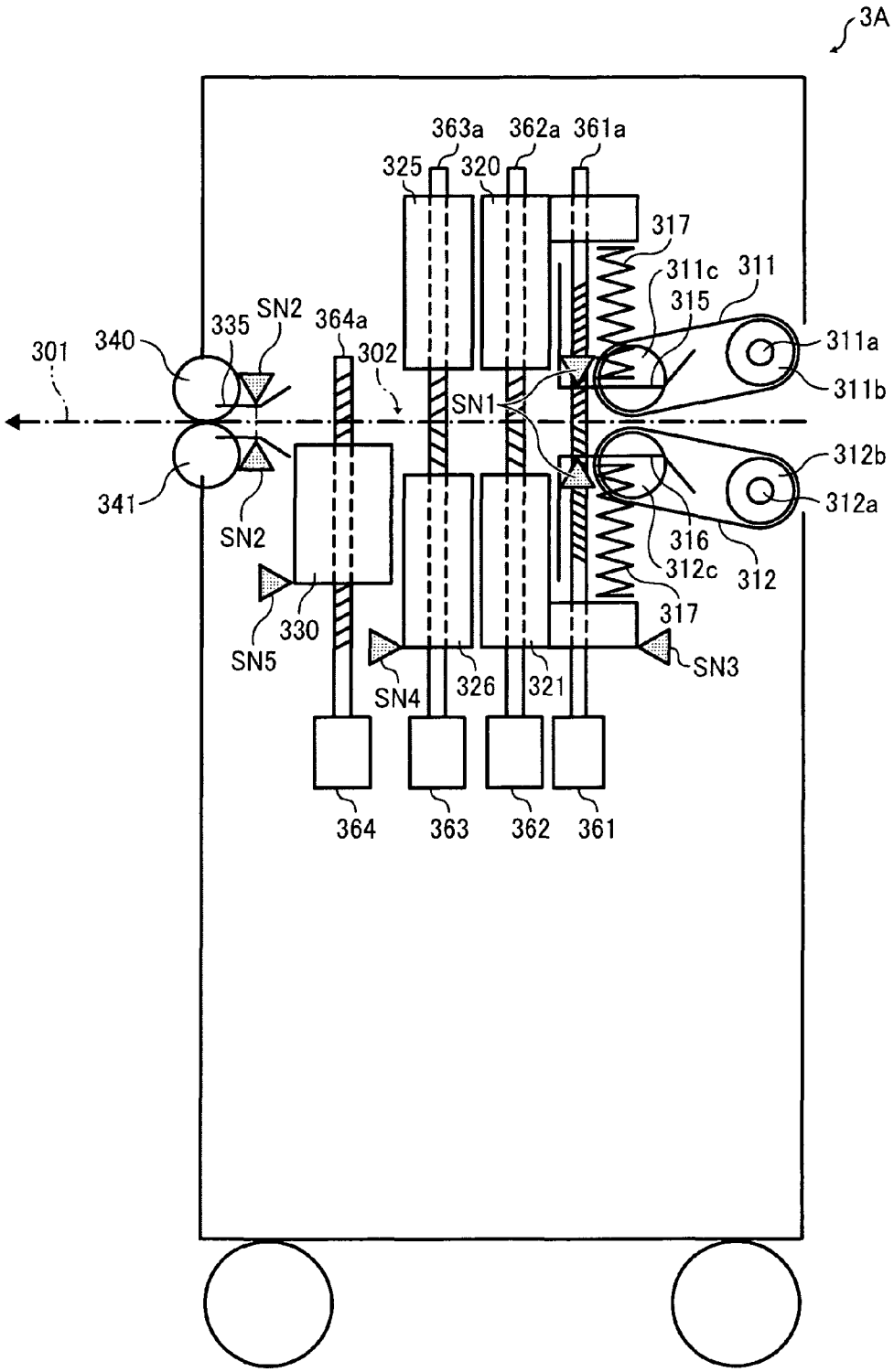
FIG. 18 illustrates a configuration of a spine formation device according to an illustrative embodiment that uses a screw driving to move a pair of guide plates, the pair of auxiliary sandwiching plates, the pair of sandwiching plates, and the contact plate.

It is to be noted that, alternatively, screw driving may be used to move the guide plates 315 and 316, the auxiliary sandwiching plates 320 and 321, the sandwiching plates 325 and 326, and the contact plate 330. FIG. 18 illustrates a configuration of a spine formation device 3A that includes driving motors 361, 362, 363, and 364 and screw shafts 361*a*, 362*a*, 363*a*, and 364*a* coaxially with driving shafts of the driving motors 361 through 364, respectively, as the driving mechanism to drive the respective portions. The motors 361 through 364 respectively include decelerators. The screw shafts 361*a*, 362*a*, and 363*a* to drive the guide plates 315 and 316, the auxiliary sandwiching plates 320 and 321, and the sandwiching plates 325 and 326 each have a screw thread winding in opposite directions from a center portion (in FIG. 18, the transport centerline 301). In FIG. 18, the upper auxiliary sandwiching plate 320 and the lower auxiliary sandwiching plate 321 are respectively attached to the upper portions and the lower portions of the screw shafts 361*a* and 362*a* having the screw threads winding in the opposite directions. Similarly, the upper sandwiching plate 325 and the lower sandwiching plate 326 are respectively attached to the upper portion and the lower portion of the screw shaft 363*a* having the screw thread winding in the opposite directions. With this configuration, the pair of the auxiliary sandwiching plates 320 and 321 and the pair of sandwiching plates 325 and 326 can move symmetrically in the direction to approach and the direction away from each other depending on the rotation direction of the driving motors 361, 362, and 363. The axis of symmetry thereof is the transport centerline 301. The driving motor 364 and the screw shaft 364*a* coaxially therewith move the contact plate 330 vertically in FIG. 18.

The screw shafts 361*a*, 362*a*, 363*a*, and 364*a* are disposed on the back side of the spine formation device 3A, outside the sheet area in which the booklet passes through, and a guide rod, not shown, is provided on the front side outside the sheet area. With this configuration, the pair of guide plates 315 and 316, the pair of the auxiliary sandwiching plates 320 and 321, the pair of sandwiching plates 325 and 326, and the contact plate 330 can move vertically in parallel to the respective screw shafts 361*a*, 362*a*, 363*a*, and 364*a* engaged therewith as well as the respective guide rods.

Referring to FIG. 8, the discharge unit 33 is disposed downstream from the contact plate 330. The discharge unit 33 includes the pair of discharge guide plates 335 and the pair of discharge rollers 340 and 341 to discharge the booklet SB outside the spine formation device 3 after spine formation. The transport detector SN1 detects the folded portion of the booklet SB. The position of the booklet SB during spine formation is set by adjusting the distance by which the booklet SB is transported from the position detected by the transport detector SN1. More specifically, the distance by which the booklet SB is transported from the position detected by the sheet detector SN1 to the position at which the booklet SB is kept during spine formation is a sum of the distance by which the booklet SB is moved from the detected position to the contact position between the folded portion (first distance) and the contact plate 330 and the distance from the contact position (second distance). The second distance can be predetermined in accordance with the amount of bulging, that is, the portion expanded in the thickness direction, necessary to shape the folded portion into the spine. This transport distance can be adjusted through pulse control, control using an encoder, or the like. Additionally, the discharge detector SN2 is provided upstream from the lower discharge roller 341, adjacent thereto, and detects the passage of the booklet SB in the transport path 302.

FIGS. 11 through 17 illustrate spine formation performed by the spine formation device 3 to flatten the spine of the booklet SB as well as the front cover side and the bock cover side thereof.

Referring to FIGS. 11 through 17, operations performed by the spine formation device 3 to flatten the folded portion, that is, the spine, of the booklet SB are described in further detail below.

Figure 11:
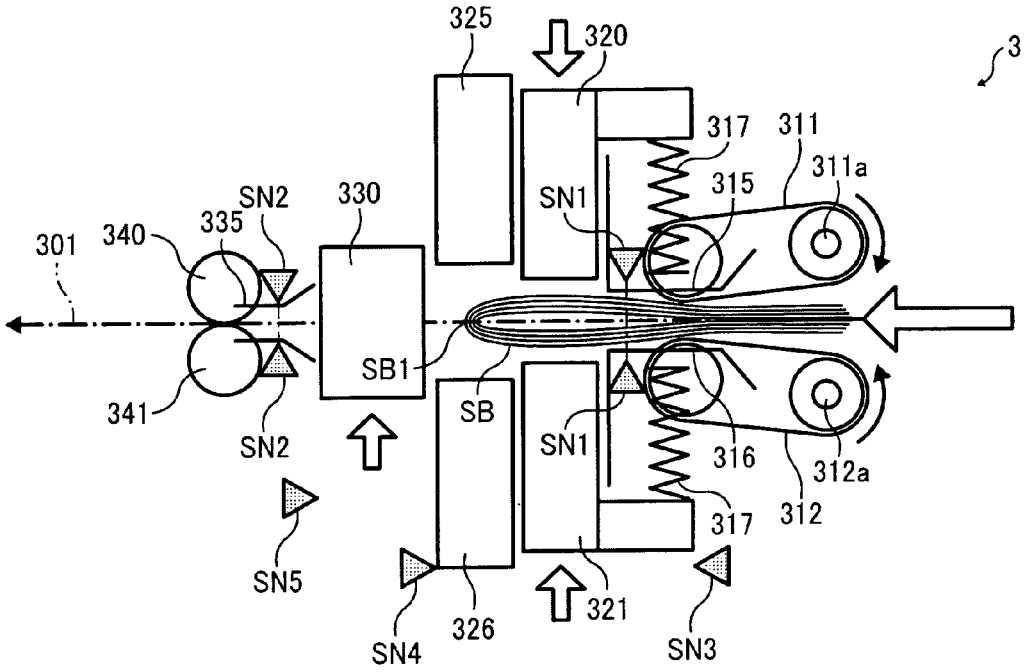
FIG. 11 illustrates a state of the spine formation device in which the bundle of folded sheets is transported therein.

Referring to FIG. 11, according to a detection signal of the booklet SB generated by an entrance sensor, not shown, of the spine formation device 3 or the folded portion detector 293 (shown in FIG. 7) of the bookbinding device 2, the respective portions of the spine formation device 3 perform preparatory operations to receive the booklet SB. In the preparatory operations, the pair of transport belts 311 and 312 starts rotating. Additionally, the upper auxiliary sandwiching plate 320 and the lower auxiliary sandwiching plate 321 move to the respective home positions detected by the auxiliary sandwiching plate HP detector SN3, move toward the transport centerline 301 until the distance (hereinafter "transport gap E") therebetween becomes a predetermined distance, and then stop at those positions. Similarly, the upper sandwiching plate 325 and the lower sandwiching plate 326 move to the respective home positions detected by the sandwiching plate HP detector SN4, move toward the transport centerline 301 until the distance (hereinafter "transport gap") therebetween becomes a predetermined distance, and then stop at those positions. It is to be noted that, because the pair of auxiliary sandwiching plates 320 and 321 as well as the pair of sandwiching plates 325 and 326 are disposed and move symmetrically relative to the transport centerline 301, when only one of the counterparts in the pair is detected at the home position, it is known that the other is at the home position as well. Therefore, the auxiliary sandwiching plate HP detector SN3 and the sandwiching plate HP detector SN4 are disposed on only one side of the transport centerline 301. The contact plate 330 moves to the home position detected by the contact plate HP detector SN5, moves toward the transport centerline 301*a* predetermined distance, and then stops at a position obstructing the transport path 302. This state before the booklet SB enters the spine formation device 3 is shown in FIG. 11.

Figure 12:
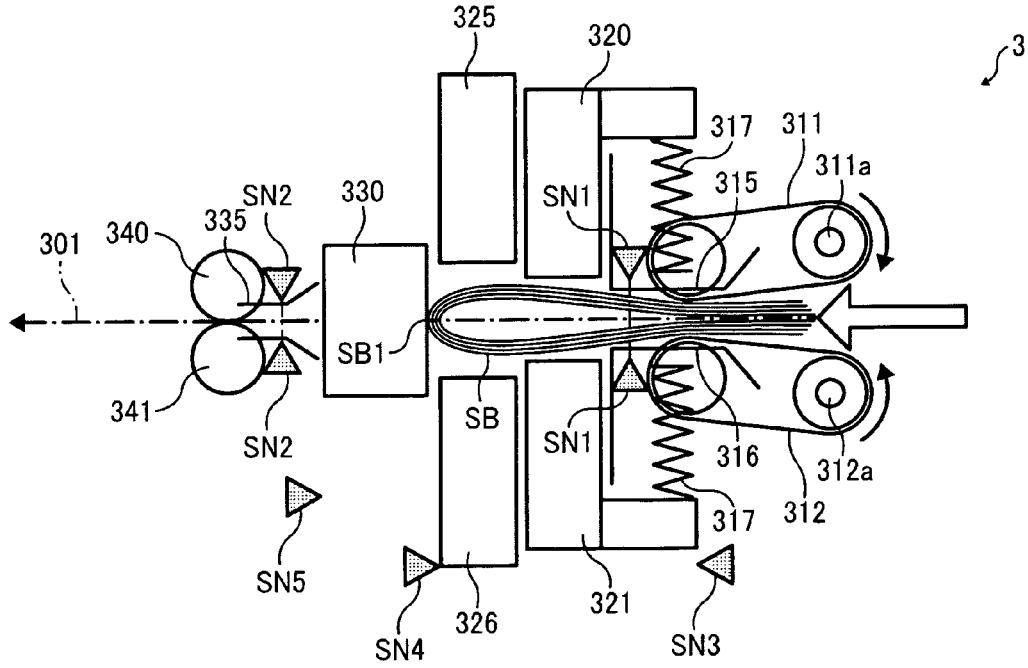
FIG. 12 illustrates a process of spine formation performed by the spine formation device in which the leading edge of the bundle of folded sheets is in contact with a contact plate.

In this state, when the booklet SB is forwarded by the discharge rollers 231 of the bookbinding device 2 to the spine formation device 3, the rotating transport belts 311 and 312 transport the booklet SB inside the device as shown in FIG. 11. The transport detector SN1 detects the folded portion SB1 of the booklet SB. The booklet SB is transported a predetermined transport distance that is the sum of the distance until the folded portion SB1 contacts the contact plate 330 and the distance necessary to form the spine by expanding the folded portion SB1 in the thickness direction, after which the booklet SB is kept at that position as shown in FIG. 12. The predetermined transport distance is set corresponding to the data relating to the booklet SB such as the thickness, the sheet size, the quantity of sheets, and the special sheet classification of the booklet SB.

Figure 13:
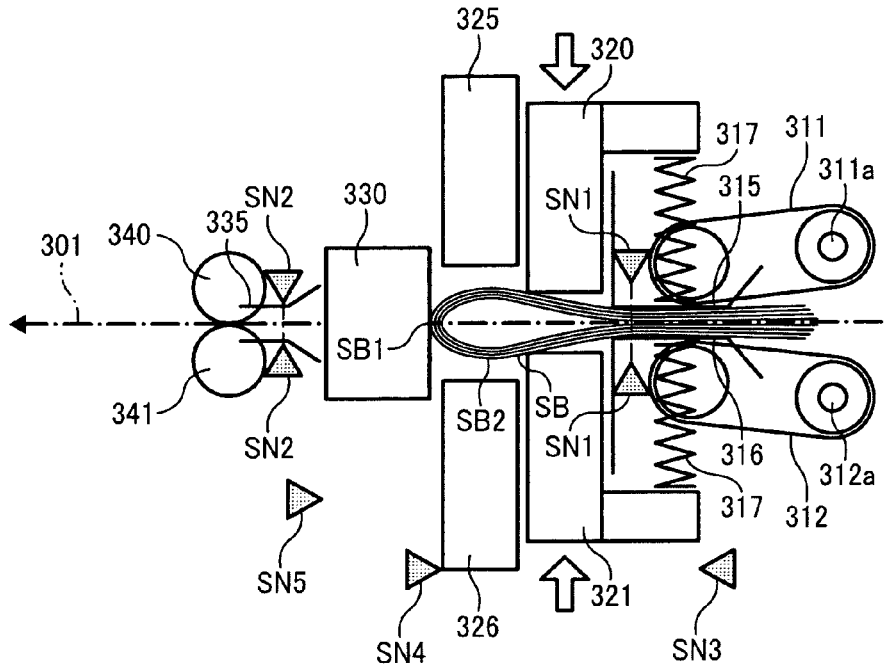
FIG. 13 illustrates a process of spine formation performed by the spine formation device in which a pair of auxiliary sandwiching plates approaches the bundle of folded sheets to sandwich it therein.
Figure 14:
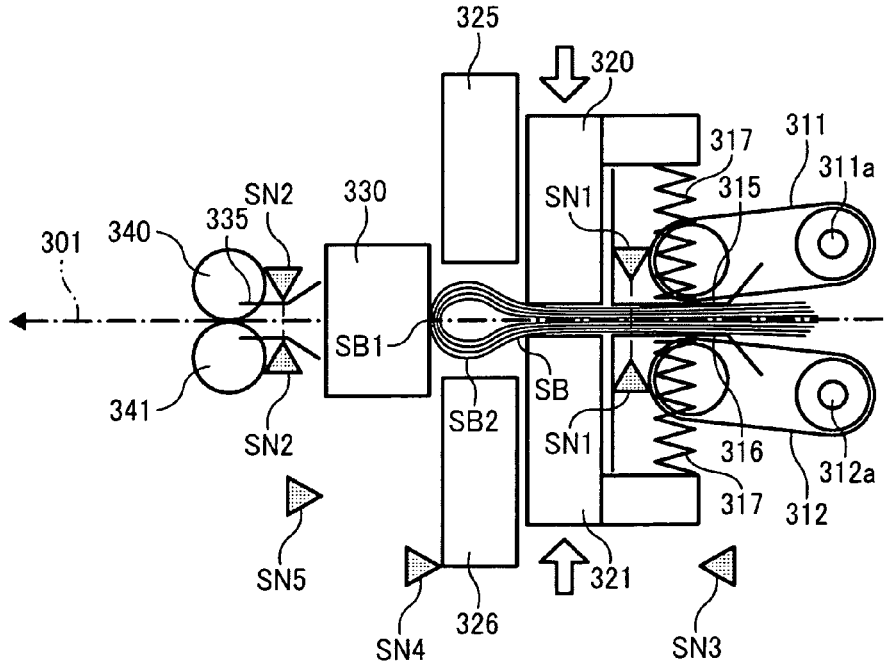
FIG. 14 illustrates a process of spine formation performed by the spine formation device in which the pair of auxiliary sandwiching plates squeezes the bundle of folded sheets.

When the booklet SB is stopped in the state shown in FIG. 12, referring to FIG. 13, the auxiliary sandwiching plates 320 and 321 start approaching the transport centerline 301, and the pair of guide plates 315 and 316 presses against the booklet SB sandwiched therein with the elastic force of the pressure springs 317 initially. After the pair of guide plates 315 and 316 start applying a predetermined pressure to the booklet SB, the auxiliary sandwiching plates 320 and 321 further approach the transport centerline 301 to squeeze the booklet SB in the portion downstream form the portion sandwiched by the guide plates 315 and 316 and then stop moving when the pressure to the booklet SB reaches a predetermine or given pressure, with the booklet SB held with the predetermined pressure as shown in FIG. 14. With the folded leading-edge portion SB1 of the booklet SB pressed against the contact plate 330, the bulging portion SB2 upstream from the folded leading-edge portion SB1 is larger than that shown in FIG. 13.

Figure 15:
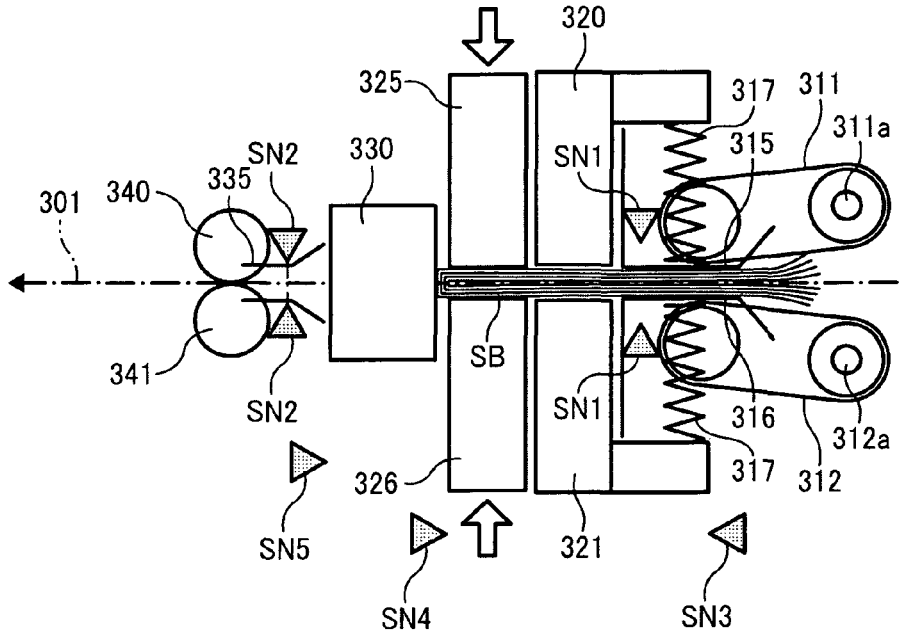
FIG. 15 illustrates a process of spine formation performed by the spine formation device in which a pair of sandwiching plates squeezes the bundle of folded sheets.

After the auxiliary sandwiching plates 320 and 321 squeeze the booklet SB as shown in FIG. 14, the sandwiching plates 325 and 326 start approaching the transport centerline 301 as shown in FIG. 15. With this movement, the bulging portion SB2 is localized to the side of the folded leading-edge portion SB1, pressed gradually, and then deforms following the shape of the space defined by the pair of sandwiching plates 325 and 326 and the contact plate 330. After this compressing operation is completed, the folded portion SB1 of the booklet SB is flat following the surface of the contact plate 330, and thus the flat spine is formed on the booklet SB. In addition, leading end portions SB3 and SB4 on the front side (front cover) and the back side (back cover) are flattened as well. Thus, as shown in FIG. 17, booklets having square spines can be produced.

Figure 16:
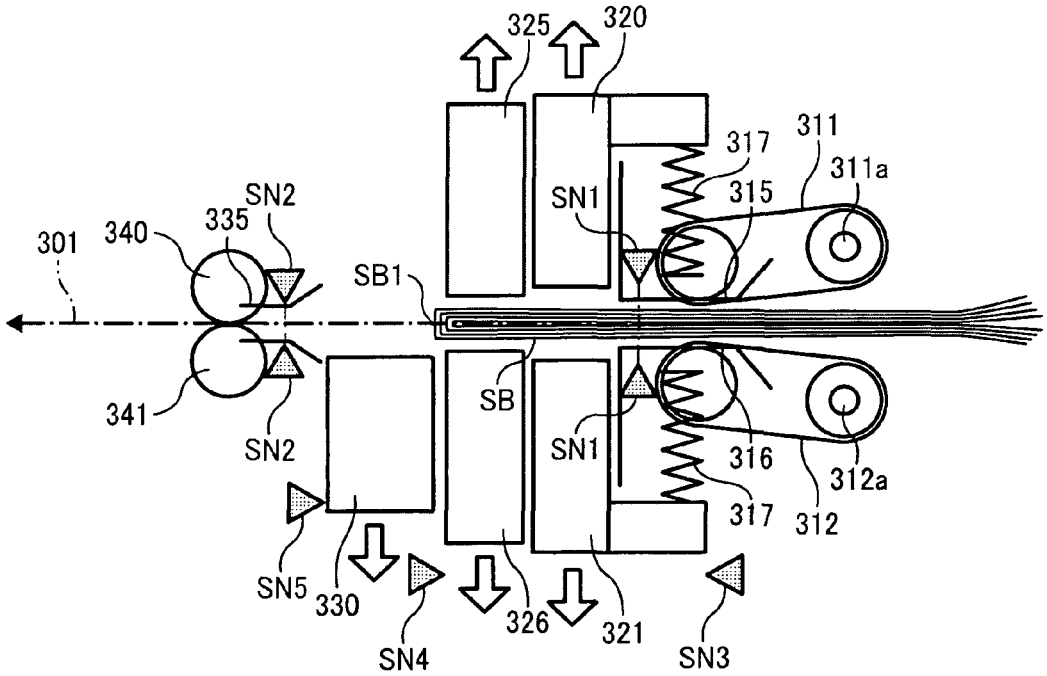
FIG. 16 illustrates completion of spine formation performed by the spine formation device in which the pair of auxiliary sandwiching plates and the pair of sandwiching plates are disengaged from the bundle of folded sheets.

Subsequently, as shown in FIG. 16, the auxiliary sandwiching plates 320 and 321 and the sandwiching plates 325 and 326 move away from the booklet SB to predetermined or given positions (standby positions), respectively. The contact plate 330 moves toward the home position and stops at a position where the top surface thereof guides the booklet SB.

Figure 17:
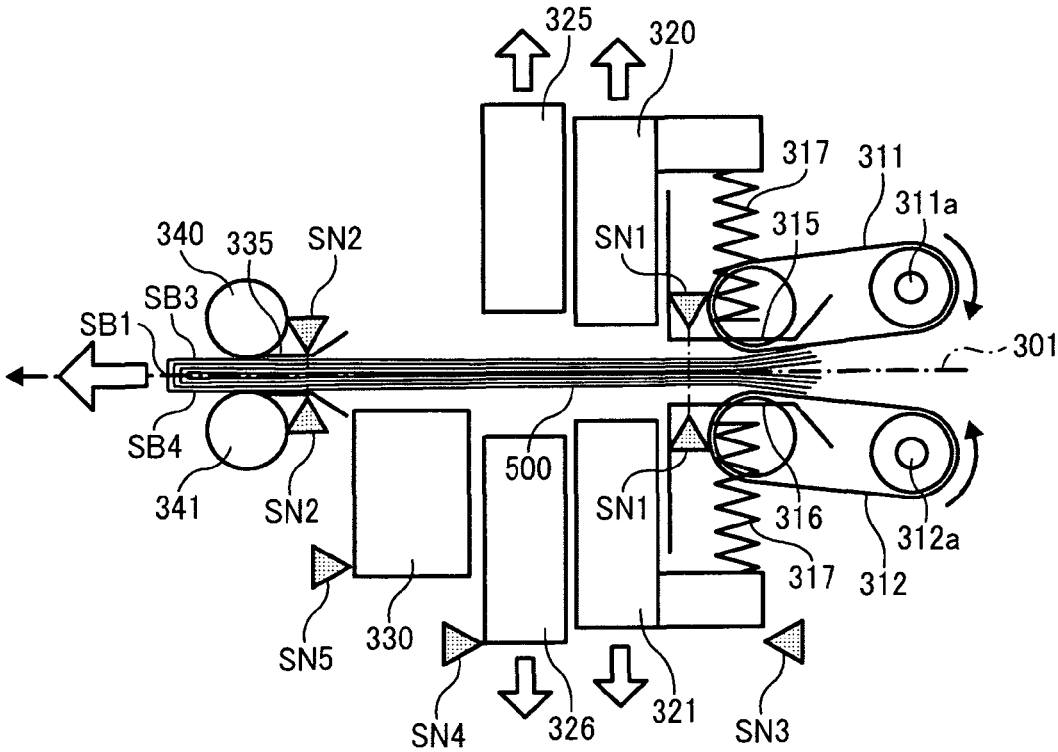
FIG. 17 illustrates a state in which the bundle of folded sheets is discharged from the spine formation device after spine formation.

After the auxiliary sandwiching plates 320 and 321, the sandwiching plates 325 and 326, and the contact plate 330 reach the respective standby positions, as shown in FIG. 17, the transport belts 311 and 312 and the pair of discharge rollers 340 and 341 start rotating, thereby discharging the booklet SB outside the spine formation device 3. Thus, a sequence of spine formation operations is completed. The transport belts 311 and 312 and the pair of discharge rollers 340 and 341 stop rotating after a predetermined time period has elapsed from the detection of the booklet SB by the discharge detector. N2. Simultaneously, the respective movable portions return to their home positions. When subsequent booklets SB are sequentially sent form the bookbinding device 2, the time point at which the rotation of the transport belts 311 and 312 and the discharge rollers 340 and 341 is stopped is varied according to the transport state of the subsequent booklet SB. Additionally, it may be unnecessary to return the respective movable portions to their home positions each time, and the position to receive the booklet SB may be varied according to the transport state of and the data relating to the subsequent booklet SB. It is to be noted that the CPU 3-1 of the spine formation device 2 in the control circuit of the bookbinding system performs these adjustments.

A control block of the bookbinding system is described below with reference to FIG. 19.

As shown in FIG. 19, the control circuit of the bookbinding system enables the online bookbinding system. FIG. 19 is a block diagram illustrating a configuration of online control of the bookbinding system. The post-processing apparatus 1 is connected to the image forming apparatus (MFP) 100 including the engine 110, and the bookbinding device 2 is connected to the post-processing apparatus 2. Further, the spine formation device 3 is connected to the bookbinding device 2. The MFP 100, the post-processing apparatus 1, the bookbinding device 2, and the spine formation device 3 respectively include the CPUs 100-1, 1-1, 2-1, and 3-1. The MFP 100 further includes an engine 110 and a communication port 100-2. The post-processing apparatus 1 further includes communication ports 1-2 and 1-3, the binding device 2 further includes communication ports 2-2 and 2-3, and the spine formation device 3 further includes a communication port 3-2. The MFP 1 and the post-processing apparatus 1 can communicate with each other using the communication ports 100-2 and 1-2, and post-processing apparatus 1 and the bookbinding device 2 can communicate with each other using the communication ports 1-3 and 2-2. Similarly, the bookbinding device 2 and the spine formation device 3 can communicate with each other using the communication ports 2-3 and 3-2. Additionally, the CPU 100-1 of the image forming device 100 controls indications on the operation panel 105 and inputs from users to the operation panel 105, and thus the operation panel 105 serves as a user interface.

Each of the image forming apparatus 100, the post-processing apparatus 1, the bookbinding device 2, and the spine formation device 3 further includes a read-only memory (ROM) and a random-access memory (RAM). Each of the CPUs 100-1, 1-1, 2-1, and 3-1 thereof reads out program codes from the ROM, runs the program codes in the RAM, and then performs operations defined by the program codes using the RAM as a work area and a data buffer. With this configuration, various control and operations described above or below are performed. The MFP 100, the post-processing apparatus 1, the bookbinding device 2, and the spine formation device 3 are connected in line via the communication ports 100-2, 1-2, 1-3, 2-2, 2-3, and 3-2. When post-processing of sheets is performed online, the CPUs 1-1, 2-1, and 3-1 of the post-processing apparatus 1, the bookbinding device 2, and the spine formation device 3 communicate with the CPU 100-1 of the image forming apparatus 100, and thus the post-processing of sheets is controlled by the CPU 100-1 of the MFP 100.

It is to be noted that, in this specification, "inline processing" means that at least two of image formation, processing of sheets, stapling of a bundle of sheets, and spine formation of the booklet are performed sequentially while the sheets are transported through the bookbinding system. Additionally, the bookbinding and spine formation is performed in accordance with characteristic data of the booklet SB that includes the quantity of sheets and the thickness of the bundle or thickness of the sheet at least. The characteristic data of the booklet SB may also include sheet size and the type of sheets, for example, special sheet classification. When the characteristic data of the booklet SB includes the special sheet classification, the characteristic data includes data for distinguishing the type of special sheets among overhead projector (OHP) sheets, label sheets, coated sheets, sheets folded into special shapes, and perforated sheets.

Additionally, the CPUs 100-1, 1,1, 2-1, and 3-1, the storage device including the ROMs and RAMs (not shown) of the image forming apparatus 100, the post-processing apparatus 1, the bookbinding device 2, and the spine formation device 3, the operation panel 105 of the image forming apparatus 100 function as resources when spine formation is formed via computers.

Figure 20:
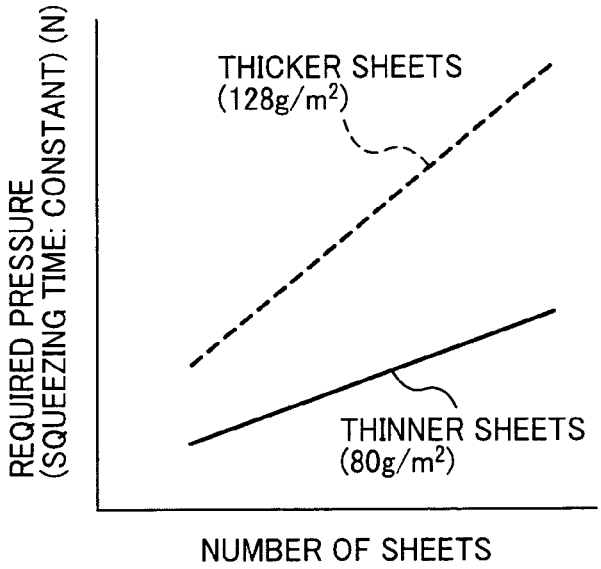
FIG. 20 illustrates the relation among the quantity of sheets, thickness of sheets, and required pressure, obtained experimentally, to flatten the spine of the booklet.

Descriptions will be given below of the pressure required for squeezing the booklet SB to the desired thickness in accordance with the characteristic of the booklet SB including the number and thickness of sheets with reference to FIG. 20 that shows the relation among the quantity of sheets, thickness of sheets, and the required pressure obtained experimentally. In FIG. 20, the vertical axis represents pressure (N) of the sandwiching plates 325 and 326 (i.e., sandwiching unit) required for squeezing the booklet SB to a desired thickness and the horizontal axis represents the quantity of sheets forming the booklet SB. In FIG. 20, a solid line and broken lines respectively represent experimental data of thinner sheets having a unit weight of 80 g/m$^2$ and thicker sheets having a unit weight of 128 g/m$^2$. In the experiment, the duration of squeezing was constant for each type of the booklet SB. According to the results shown in FIG. 20, the required pressure increases as the sheet thickness increases or the quantity of sheets increases.

Figure 21:
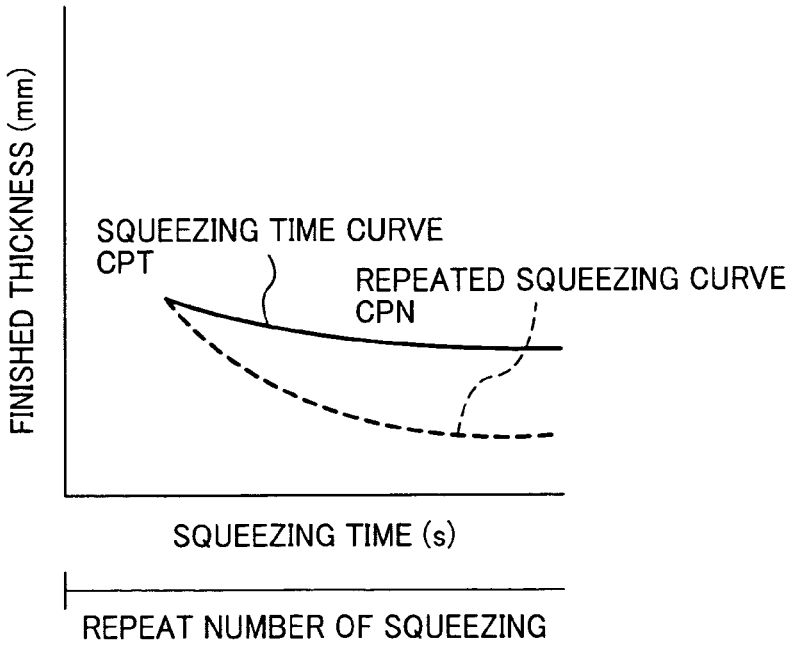
FIG. 21 illustrates the relation between the required time for squeezing the booklet and the finished thickness when the booklet is squeezed with a given constant pressure.

FIG. 21 shows the relation between the required time for squeezing the booklet SB (hereinafter "squeezing time") and the finished thickness. In FIG. 21, the vertical axis and the horizontal axis respectively represent the finished thickness of the booklet and the squeezing time when the booklet is squeezed with a constant pressure. FIG. 21 shows properties of two cases of flattening the spine of the booklet. In case 1, the spine of the booklet is simply squeezed with a given constant pressure and is kept in that state, and solid line CPT (hereinafter "squeezing time curve CPT") in FIG. 21 represents the results of case 1. By contrast, in case 2, the spine (i.e., folded portion) of the booklet is bent repeatedly, thereby loosening the fibers, to reduce the finished thickness, and broken lines CPN (hereinafter "repeated or intermittent squeezing curve CPN") represent the results of case 2. The vertical axis and the horizontal axis respectively represent the finished thickness (mm) and the squeezing time (s) or the number of times squeezing is repeated. In the case 2, in spine formation, squeezing the spine (folded portion) of the booklet and disengaging the sandwiching units from the spine of the booklet are repeated alternately so as to loosen the fibers, thereby reducing the finished thickness, and the time of the spine formation is plotted in the time course similar to that of the above-described squeezing time. From FIG. 21, it can be known that, when squeezing time is increased, the finished thickness is reduced gradually. Additionally, even in the same duration of time, the finished thickness can be reduced significantly when squeezing and pressure releasing are repeated alternately.

Next, energy required for squeezing the spine of the booklet is described below.

In squeezing of the spine of the booklet, the energy consumption increases in proportion to increases in the pressure. By contrast, in spine formation in which squeezing the spine of the booklet with a given constant pressure is continued, energy consumption can be reduced by using the screw mechanism or cam mechanism for moving the sandwiching plates 325 and 326. That is, to reduce energy consumption, squeezing the spine of the booklet with a smaller constant pressure for a relatively long time is effective.

However, in the bookbinding system to which the image forming apparatus 100, the post-processing apparatus 1, the bookbinding device 2, and the spine formation device 3 are connected, the duration in which the sandwiching plates 325 and 326 squeeze the spine of the booklet SB with the folded leading-edge portion of the booklet SB pressed against the contact plate 330, as shown in FIG. 15, is limited. When the squeezing time is limited, to perform spine formation without stopping the system, either the pressure of squeezing is increased or the number of times squeezing is repeated is increased (squeezing repeat-number set mode). Increasing the pressure of squeezing is based on the properties shown in FIG. 20, and increasing the number of times squeezing is repeated is based on the properties shown in FIG. 21. By using one of these in spine formation, booklets can be squeezed to desired finished thickness (target finished thickness) without stopping the system.

It is to be noted that, to reduce energy consumption, 2) increasing the number of times squeezing is repeated is preferred because energy consumption increases as the pressure increases as described above. Therefore, in the present embodiment, the pressure of squeezing is kept constant, and the squeezing duration is increased within the limit of the squeezing duration (squeezing-duration set mode) and the number of times squeezing is repeated is increased (squeezing repeat-number set mode) when the squeezing duration exceeds the limit.

Descriptions will be given below of operation according to the present embodiment for squeezing booklets to target finished thicknesses in the bookbinding system connected to the image forming apparatus 100 without stopping the system.

The spine formation device 3 switches the control modes between the above-described two modes in accordance with the date transmitted from the image forming apparatus 100 including sheet thickness, the quantity of sheets, sheet width, and special sheet classification (OHP sheets, label sheets, coated sheets, sheets folded into special shapes, or perforated sheets).

Figure 22:
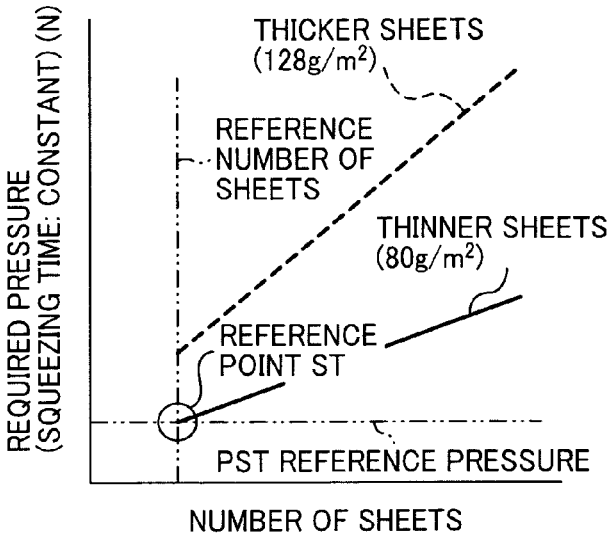
FIG. 22 illustrates the relation between the quantity of sheets forming the booklet and the required pressure.

FIG. 22 illustrates the relation between the quantity of sheets forming the booklet and the required pressure. Referring to FIG. 22, in a first step, a reference point ST, which is a point on the graph representing the relation between the quantity of sheets and the required pressure, is selected in accordance with the quantity of sheets forming the booklet and the pressure. The reference point ST is determined based on reference number of sheets MST and reference pressure PST. In the case shown in FIG. 22, the reference point ST is the pressure required for a smallest number of sheets. Alternatively, in view of the overall balance, the reference point ST may be a median value of the maximum number of sheets that the spine formation device 3 can accommodate.

In the case shown in FIG. 22, the reference point ST is set to a point of an edge of the experimental data of thinner sheets having a unit weight of 80 g/m$^2$, which is circled in FIG. 22, as described above, and the reference number of sheets MST and the reference pressure PST are determined in accordance with the reference point ST. It is to be noted that the reference point ST is set and adjusted according to the data of sheet thickness and sheet width practically. Switching of the control mode in the case of thinner sheets having a unit weight of 80 g/m$^2$ is further described below.

Figure 23:
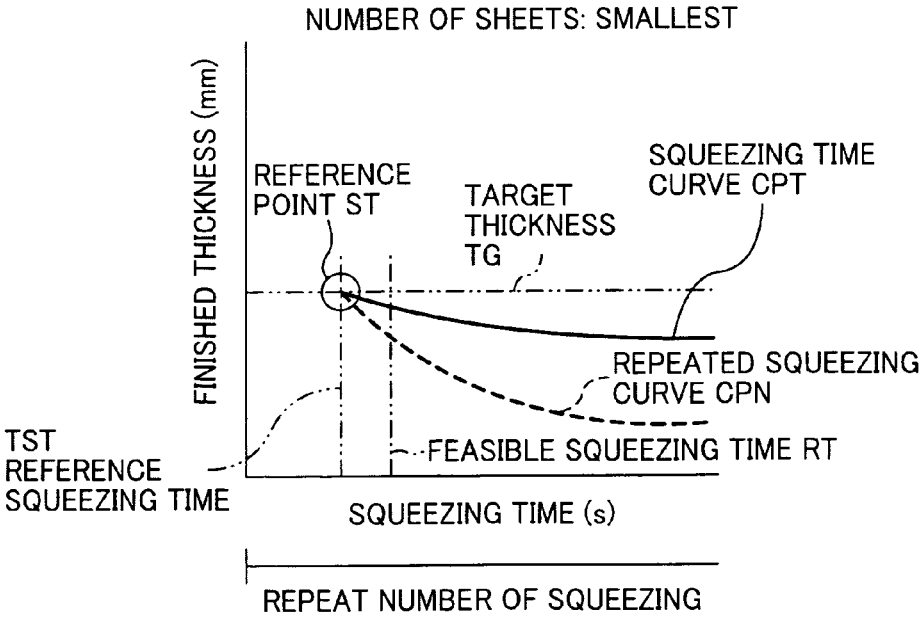
FIG. 23 illustrates operation for squeezing the spine of the booklet to the desired thickness without stopping the system and shows the finished thickness and the squeezing time corresponding to FIG. 21.

Then, in a second step, the constant squeezing time set in the measurement of the date shown in FIG. 22 is plotted in the graph shown in FIG. 23 as the reference squeezing time TST. At this time, at the reference point ST indicated by a circle shown in FIG. 23, the finished thickness attained during the reference squeezing time TST equals to a target thickness TG. Naturally, the reference squeezing time TST is shorter than feasible squeezing time RT that is a limit of the squeezing time feasible by the system.

It is to be noted that FIG. 23 illustrates a case in which the quantity of sheets is the smallest.

Figure 24:
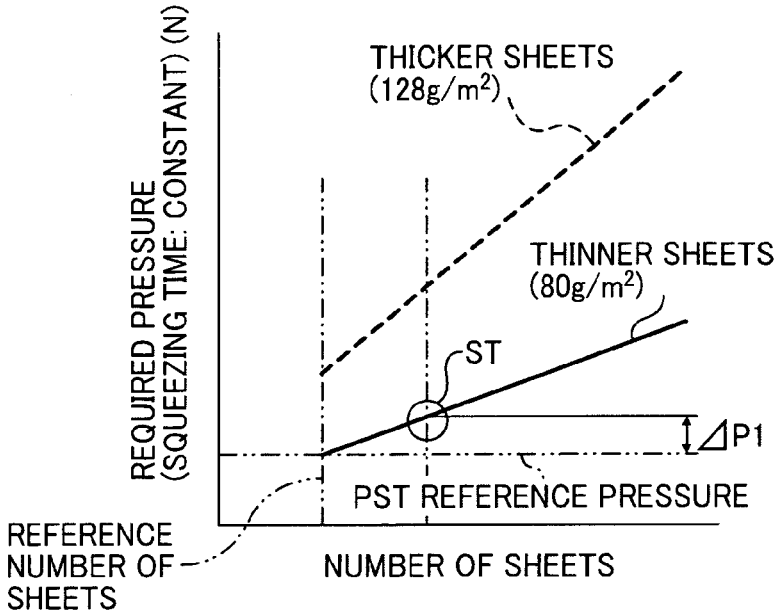
FIG. 24 illustrates the relation between the quantity of sheets and the pressure, in which the required pressure for smaller number of sheets is circled.

FIG. 24 illustrates the relation between the quantity of sheets and the pressure, in which the required pressure for smaller number of sheets is circled.

Figure 25:
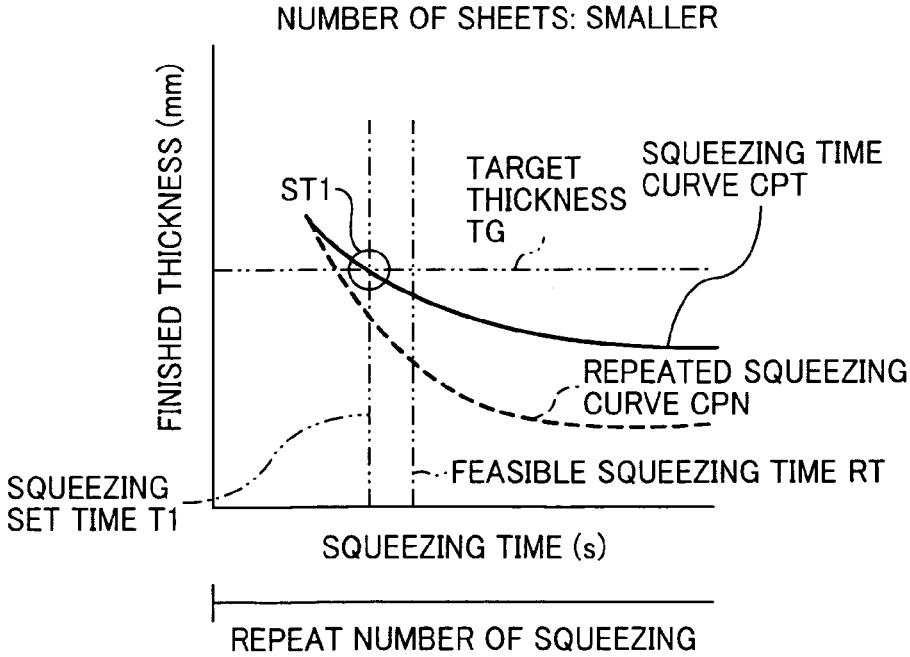
FIG. 25 illustrates the relation between the finished thickness and the squeezing time when the booklet is squeezed with a given constant pressure and corresponds to FIG. 23.

In the case shown in FIG. 24, the reference point ST is set when the reference number of sheets MST is set to a relatively smaller number although greater than that in FIGS. 22 and 23, and the reference pressure PST is the pressure required for the smaller number of sheets. At the reference point ST, the reference pressure PST is insufficient by a shortfall ΔP1 relative to the required pressure. To attain the target finished thickness of the booklet by increasing the squeezing time without changing the reference pressure PST in order to restrict the energy consumption, the squeezing time is increased to a squeezing set time T1 at the point where the line of the target thickness TG crosses the squeezing time curve CPT. More specifically, whether or not the squeezing set time T1 is smaller than the feasible squeezing time RT, and then the squeezing time is adjusted to the squeezing set time T1 when the squeezing set time T1 is smaller than the feasible squeezing time RT. It is to be noted that, the constant squeezing time set in the measurement of the date shown in FIG. 24 is plotted as the reference squeezing time TST in the graph shown in FIG. 25 similarly to the graph shown in FIG. 23.

Figure 26:
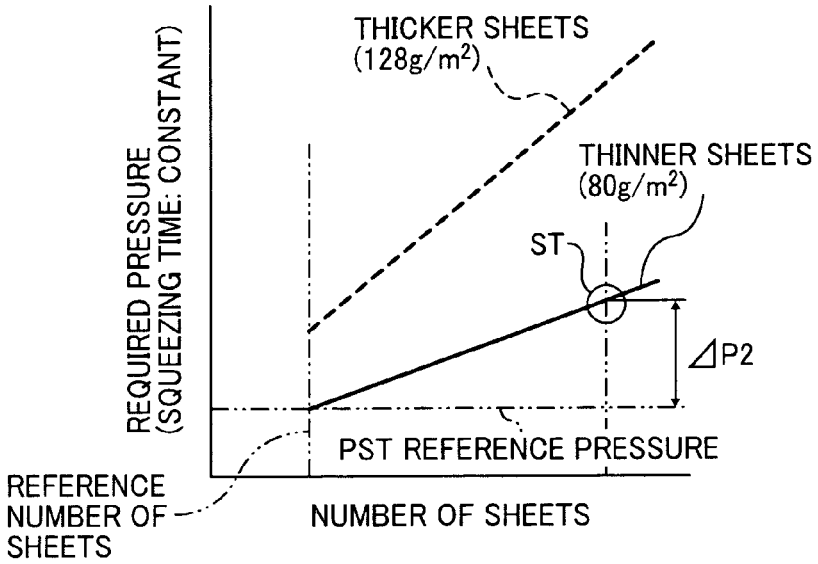
FIG. 26 illustrates the relation between the quantity of sheets and the pressure, in which the required pressure for greater number of sheets is circled.

FIG. 26 illustrates the relation between the quantity of sheets and the pressure, in which the required pressure for greater number of sheets is circled.

In FIG. 26, at the reference point ST, the reference pressure PST is insufficient by a shortfall ΔP2, greater than the shortfall ΔP1 in FIG. 24 (ΔP1<ΔP2), relative to the required pressure. From the results shown in FIG. 27, it can be known that when the quantity of sheets is relatively large, a longer squeezing time is necessary because the reference pressure PST is insufficient.

Figure 27:
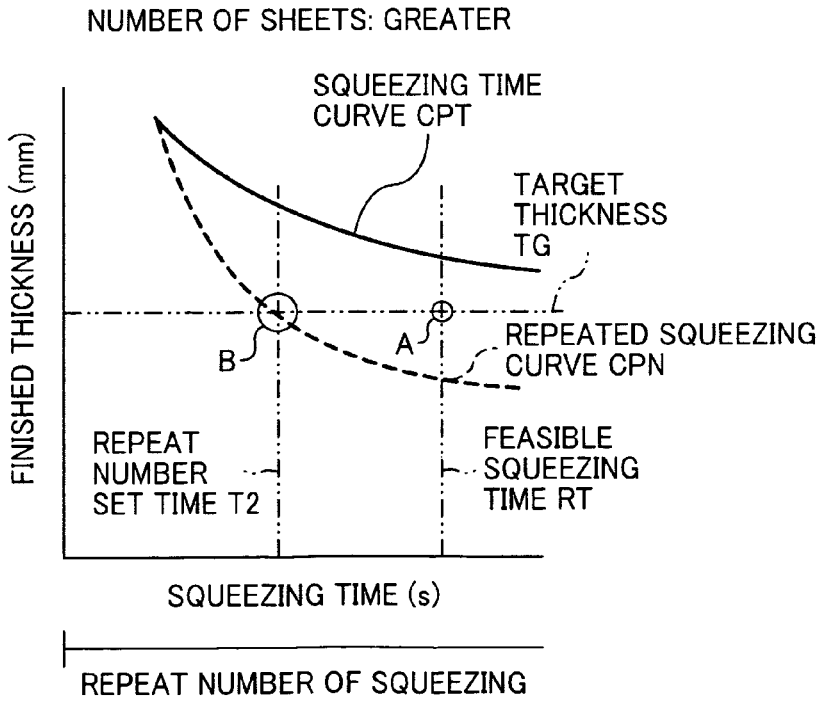
FIG. 27 illustrates the relation between the finished thickness and the squeezing time when the booklet is squeezed with a given constant pressure and corresponds to FIG. 23.

In view of the foregoing, as shown in FIG. 27, the constant squeezing time set in the measurement of the date shown in FIG. 26 is plotted in the graph shown in FIG. 27 as the reference squeezing time TST. In this graph, a point where the line of target thickness TG and the squeezing time curve CPT is greater than the feasible squeezing time RT. More specifically, in FIG. 27, reference character A represents the point where the line of feasible squeezing time RT crosses the line of target thickness TG, and FIG. 27 shows that the booklet cannot be squeezed to the target thickness TG within the feasible squeezing time RT under process conditions at the point A. Although solved by adjusting the squeezing time when the quantity of sheets is smaller, insufficient squeezing cannot be solved with only squeezing time adjustment (squeezing-duration set mode) when the quantity of sheets is greater.

Meanwhile, regarding the repeated squeezing curve CPN, a point B where the line of target thickness TG crosses the repeated squeezing curve CPN is not greater than the feasible squeezing time RT in FIG. 27. Therefore, when squeezing time adjustment cannot relieve insufficient squeezing like in this case, the squeezing repeat-number set mode that uses the repeated squeezing curve CPN is used. More specifically, the number of times squeezing is repeated is set to a repeat set value T2, and the number of repetition of squeezing is determined based on the repeat set value T2.

As described above, the set values are determined based on the experimental data in accordance with the characteristic data of the booklet, and the control mode is switched in accordance with the characteristic data of the booklet.

It is to be noted, although the control mode is conceptually switched using the properties shown in FIGS. 20 through 27, the control mode may be determined in consideration of variously combination of sheet thickness, the quantity of sheets, capacity of the image forming apparatus 100, and the tike. Therefore, practically, proper conditions are selected depending on the differences for determining the control mode.

FIGS. 28 through 31 are tables illustrating conditions for selecting one of the control mode 1 and 2 (hereinafter "mode setting conditions or judgment conditions"), and FIGS. 32A through and 33B are flowcharts illustrating procedures of mode setting using the judgment conditions shown in FIGS. 28 through 31 for squeezing booklets to target finished thicknesses without stopping the system. More specifically, FIG. 28 shows judgment table 1 including mode setting conditions according to sheet thickness, FIG. 29 shows judgment table 2 including conditions for setting squeezing time according to the mode setting conditions and the quantity of sheets, FIG. 30 shows judgment table 3 including conditions for setting the number of times squeezing is repeated, and FIG. 31 shows judgment table 4 including conditions for setting squeezing time limit for each number of sheets.

The judgment table 1 shown in FIG. 28 is for selecting first-level control modes in accordance with sheet thickness, and sheet thickness is divided in three levels with thresholds of unit weights of 80 g/m$^2$ and 128 g/m$^2$. More specifically, mode A (thinner sheet mode) is selected when sheet thickness (unit weight of sheets) T is equal to or less than 80 g/m$^2$, mode B (middle-thickness sheet mode) is selected when sheet thickness T is greater than 80 g/m$^2$ and less than 128 g/m$^2$, and mode C (thicker sheet mode) is selected when sheet thickness T is greater than 128 g/m$^2$.

The judgment table 2 shown in FIG. 29 is for determining the squeezing time in accordance with the number of sheets for each of the first-level modes A through C shown in FIG. 28. For example, in the mode A (thinner sheet mode), when the number of sheets is 1 to 5, the squeezing time is 1 second. Similarly, when the number of sheets is within a range of 6 to 10, a range of 11 to 15, and a range of 16 to 20, the squeezing time is 3 seconds, 7 seconds, and 12 seconds, respectively. In the mode B (middle-thickness sheet mode), when the number of sheets is 1 to 5, the squeezing time is 2 second. Similarly, when the number of sheets is within a range of 6 to 10, a range of 11 to 15, and a range of 16 to 20, the squeezing time is 5 seconds, 10 seconds, and 15 seconds, respectively.

The judgment table 3 shown in FIG. 30 is for determining the number of times squeezing is repeated in accordance with the number of sheets for each of the first-level modes A through C corresponding to sheet thickness shown in FIG. 28. For example, regarding the mode A, when the number of sheets is 2 to 5, the number of times squeezing is repeated is 2. Similarly, when the number of sheets is within a range of 6 to 10, a range of 11 to 15, and a range of 16 to 20, the number of times squeezing is repeated is 2, 3, and 4, respectively. Regarding the mode B, when the number of sheets is 1 to 5, the number of times squeezing is repeated is 2. Similarly, when the number of sheets is within a range of 6 to 10, a range of 11 to 15, and a range of 16 to 20, the number of times squeezing is repeated is 3, 4, and 5, respectively.

The judgment table 4 shown in FIG. 31 is for determining the squeezing time limit in accordance with the number of sheets and the image formation capacity of the image forming apparatus 100 connectable to the bookbinding system. For example, regarding the apparatus with a capacity of 130 pages per minute (PPM), when the number of sheets is 1 to 5, the squeezing time limit is 1 second. Similarly, when the number of sheets is within a range of 6 to 10, a range of 11 to 15, and a range of 16 to 20, the squeezing time limit is 3 seconds, 5 seconds, and 7 seconds, respectively. Regarding the apparatus with a capacity of 90 PPM, when the number of sheets is 1 to 5, the squeezing time limit is 1.5 seconds. Similarly, when the number of sheets is within a range of 6 to 10, a range of 11 to 15, and a range of 16 to 20, the squeezing time limit is 4.5 seconds, 7.5 seconds, and 10.5 seconds, respectively. Regarding the apparatus with a capacity of 60 PPM, when the number of sheets is 1 to 5, the squeezing time limit is 2 seconds. Similarly, when the number of sheets is within a range of 6 to 10, a range of 11 to 15, and a range of 16 to 20, the squeezing time limit is 6 seconds, 10 seconds, and 14 seconds, respectively.

It is to be noted that, although the description above concerns setting the first-level modes in accordance with sheet thickness without considering sheet type as shown in FIG. 28, it is preferable to set three different thickness levels for each type of special sheets, namely, OHP sheets, label sheets, coated sheets, sheets folded into special shapes, or perforated sheets. With this setting, according to the special sheet classification transmitted from the CPU 100-1, one of those first-level modes can be selected. Moreover, sheet size data may be added to the conditions shown in FIGS. 28 through 31 so that the control modes can be set in further detail.

Figure 32A:
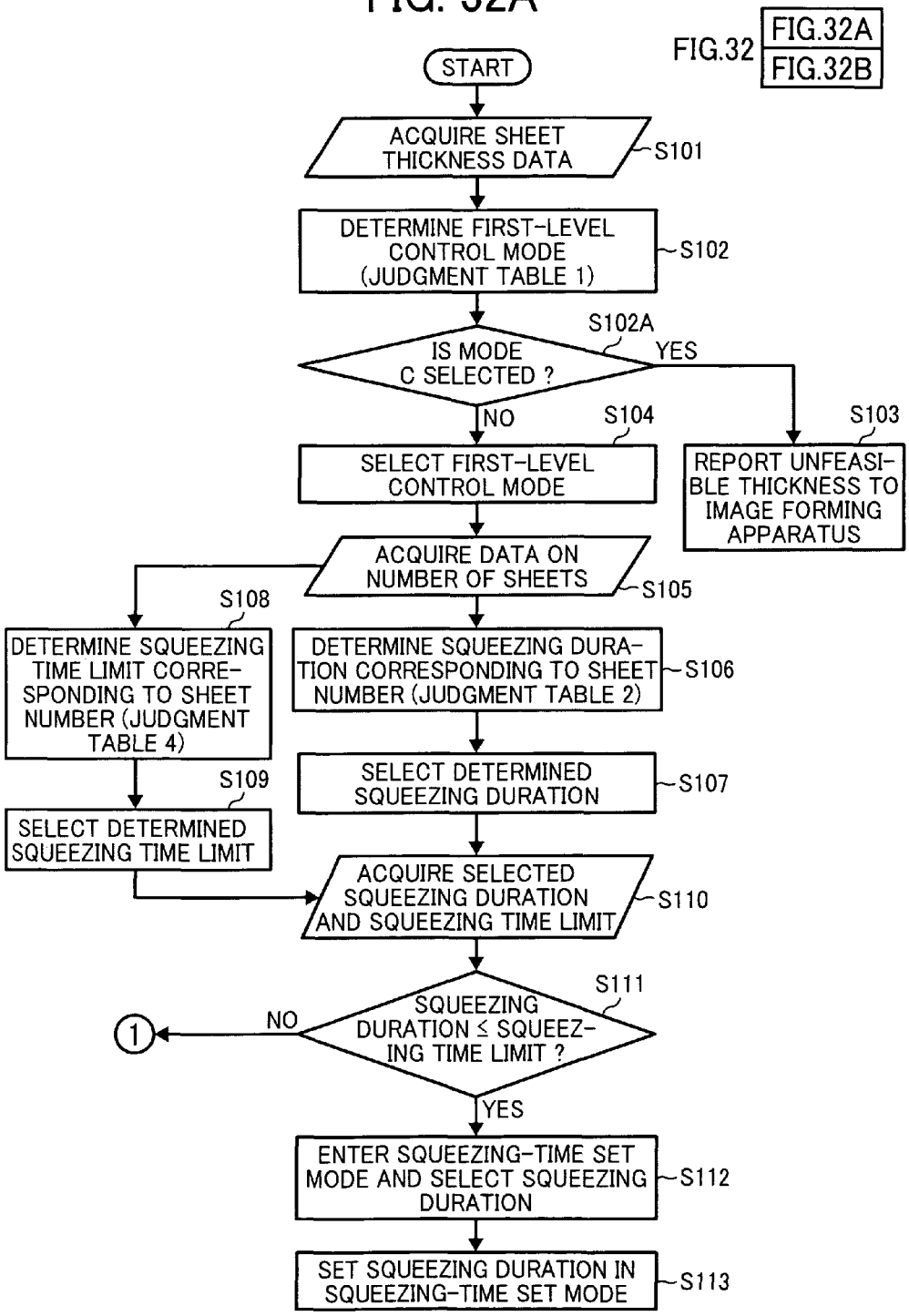
FIGS. 32A and 32B are flowcharts illustrating the procedure of spine mode setting using the judgment tables 1 through 4 shown in FIGS. 28 through 31.
Figure 32B:
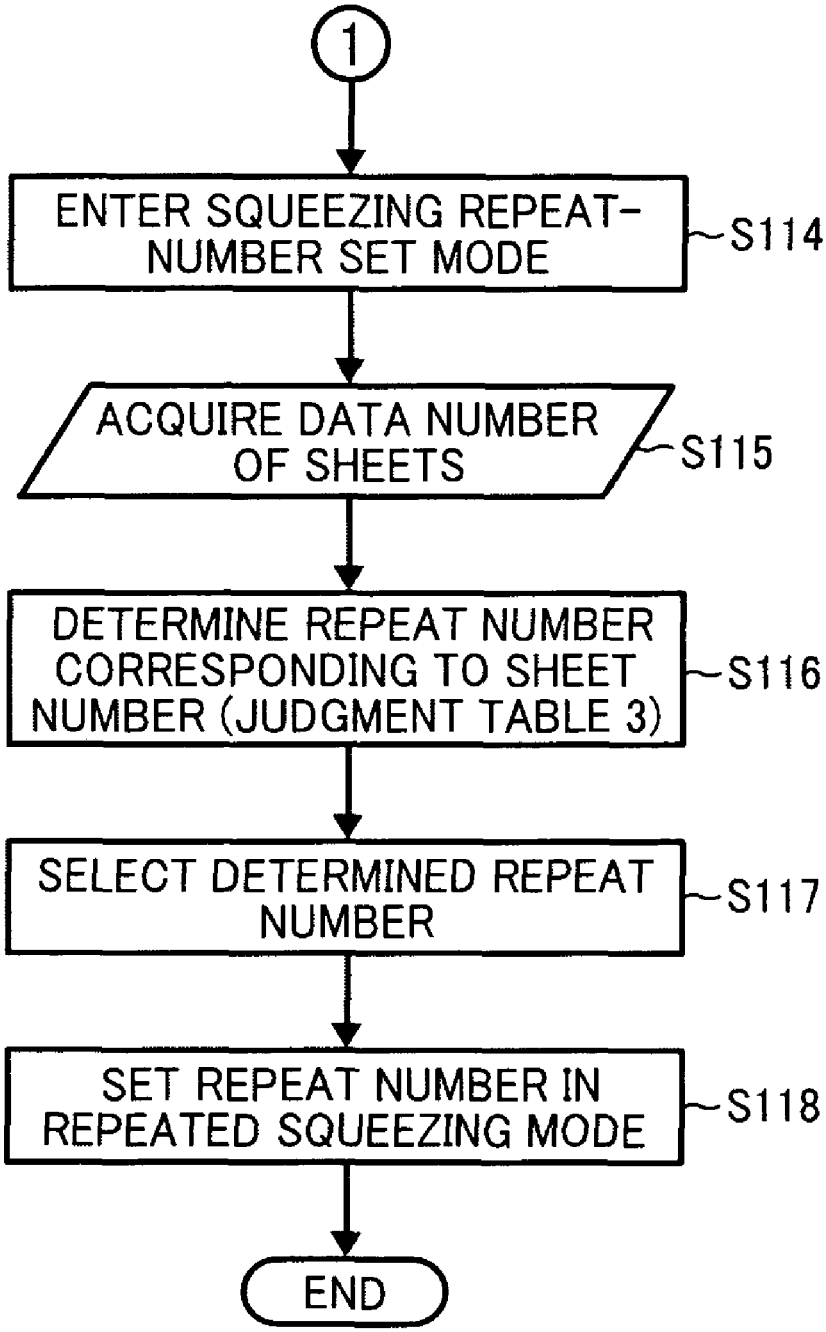

FIGS. 32A and 32B are the flowcharts illustrating the procedure of spine mode setting using the judgment tables 1 through 4 shown in FIGS. 28 through 31.

Referring to FIGS. 19, 32A, and 32B, at S 101, the CPU 3-1 (i.e., controller) of the spine formation device 3 acquires sheet thickness data from the CPU 100-1 of the image forming apparatus 100 and, at S 102, determines the first-level mode in accordance with the sheet thickness data using the judgment table 1 shown in FIG. 28. At S102A, whether or not the sheet thickness (unit weight of sheets) is greater than 128 g/m$^2$ is determined. When the mode C is selected (YES at S102A), that is, the sheet thickness (unit weight of sheets) is greater than 128 g/m$^2$, the CPU 3-1 of the spine formation device 3 reports to the CPU 100-1 of the image forming apparatus 100 "unfeasible thickness" meaning that the thickness is out of the range that the spine formation device 3 can process.

By contrast, other than the mode C (NO at S102A), at S104 either the mode A or the mode B that corresponds to the sheet thickness data is selected. At S105, the CPU 3-1 of the spine formation device 3 acquires data on the number of sheets from the CPU 100-1 of the image forming apparatus 100. At S106, the squeezing time corresponding to the number of sheets is determined according to the judgment table 2 shown in FIG. 29, and, at S107 the squeezing time is thus determined is selected. Additionally, at S108, the squeezing time limit corresponding to the number of sheet is determined referring to the judgment table 4 shown in FIG. 31, and, at S109, the squeezing time limit thus determined is selected. At S110, the CPU 3-1 of the spine formation device 3 acquires the squeezing time selected at S107 as well as the squeezing time limit selected at S109 and determines whether or not the selected squeezing time is less than the selected squeezing time limit at S110.

In this judgment, when the squeezing time is less than the squeezing time limit (YES at S111), at S112, the CPU 3-1 of the spine formation device 3 selects the above-described squeezing-duration set mode as a second-level mode and determines squeezing time. At S113, the CPU 3-1 enters the selected control mode and sets the determined squeezing time. Thus, the spine formation conditions are set.

By contrast, when the squeezing time is longer then the squeezing time limit (NO at S111), at S114 the spine formation device 3 enters the squeezing repeat-number set mode. After acquiring data on the number of sheets at S115, at S116, the CPU 3-1 of the spine formation device 3 determines the number of times squeezing is repeated corresponding to the number of sheets thus acquired according to the judgment table 3 shown in FIG. 30. At S117, the determined number of times squeezing is repeated is selected and, at S118, the selected number of times squeezing is repeated is set in the squeezing repeat-number set mode, and thus the spine formation conditions are set.

Figure 33A:
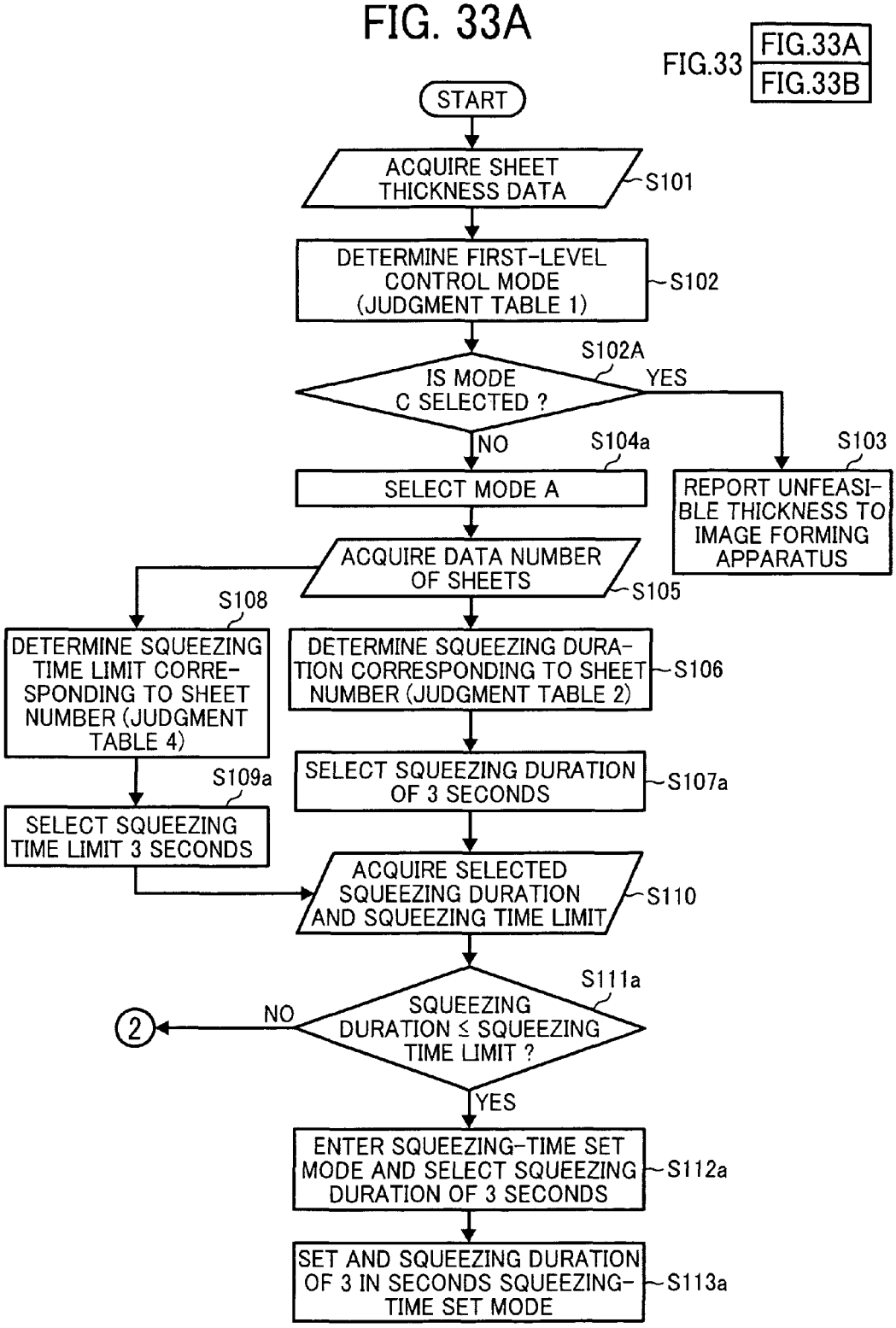
FIGS. 33A and 33B are flowcharts illustrating the procedure of control mode judgment when the spine formation device 3 is connected to the image forming apparatus having image formation capacity of 130 PPM and forms the spine of a bundle of 10 sheets whose unit weight (thickness) is 70 $g/m^2$.
Figure 33B:
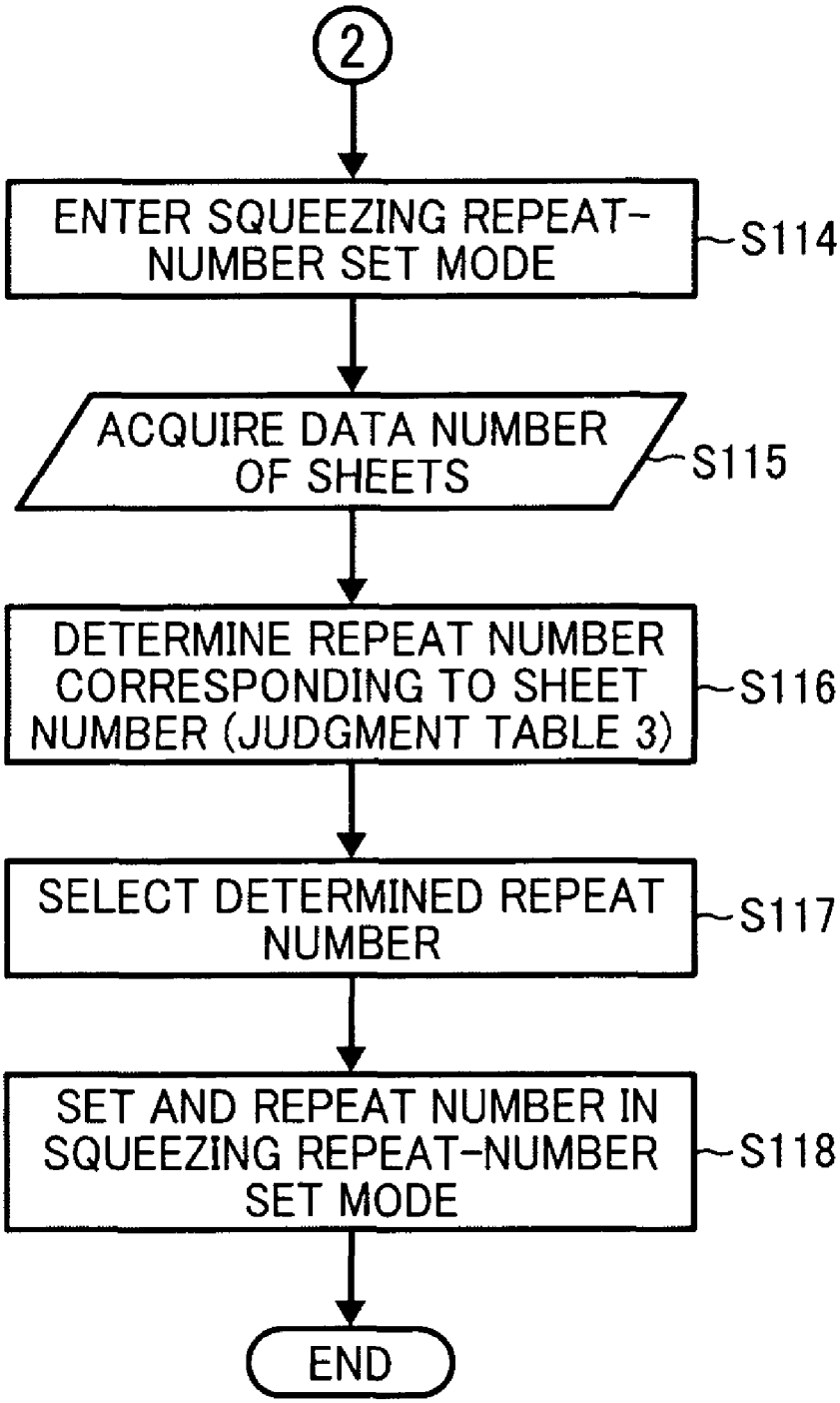

FIGS. 33A and 33B are flowcharts illustrating the procedure of control mode judgment when the spine formation device 3 is connected to the image forming apparatus having image formation capacity of 130 PPM and forms the spine of a bundle of 10 sheets whose unit weight (thickness) is 70 g/m$^2$.

Referring to FIGS. 19, 33A, and 33B, at S 101 the CPU 3-1 of the spine formation device 3 acquires sheet thickness data from the CPU 100-1 of the image forming apparatus 100. At S 102, the CPU 3-1 of the spine formation device 3 performs first-level control mode judgment in accordance with the sheet thickness data using the judgment table 1 shown in FIG. 28. In this procedure, because the sheet has a unit weight (thickness) of 70 g/m$^2$, the first-level mode according to the judgment table 1 is mode A. Therefore, at S104*a*, the CPU 3-1 of the spine formation device 3 selects mode A and acquires data on the number of sheets from the CPU 100-1 of the image forming apparatus 100. At S106, because the number of sheets is 10, the squeezing time corresponding to 10 sheets is determined according to the judgment table 2 shown in FIG. 29, and, at S107*a*, 3 seconds is selected as the squeezing time. Additionally, at S108, the squeezing time limit corresponding to the number of sheet is determined referring to the judgment table 4 shown in FIG. 31, and 3 seconds is selected as the squeezing time limit at S109*a*. At S110, the CPU 3-1 of the spine formation device 3 acquires the squeezing time selected at S107*a* as well as the squeezing time limit selected at S109*a* and determines whether or not the selected squeezing time is less than the selected squeezing time limit at S111*a*.

In this judgment, the squeezing time is 3 seconds and equals to the squeezing time limit, that is, the squeezing time is not greater than the squeezing time limit (YES at S111*a*). At S112*a*, 3 seconds is selected as the squeezing time in the squeezing-duration set mode. As a result, at S113*a*, the sheet thickness level B, the squeezing-duration set mode, and the squeezing time of 3 seconds are set as the condition for spine formation.

Figure 34A:
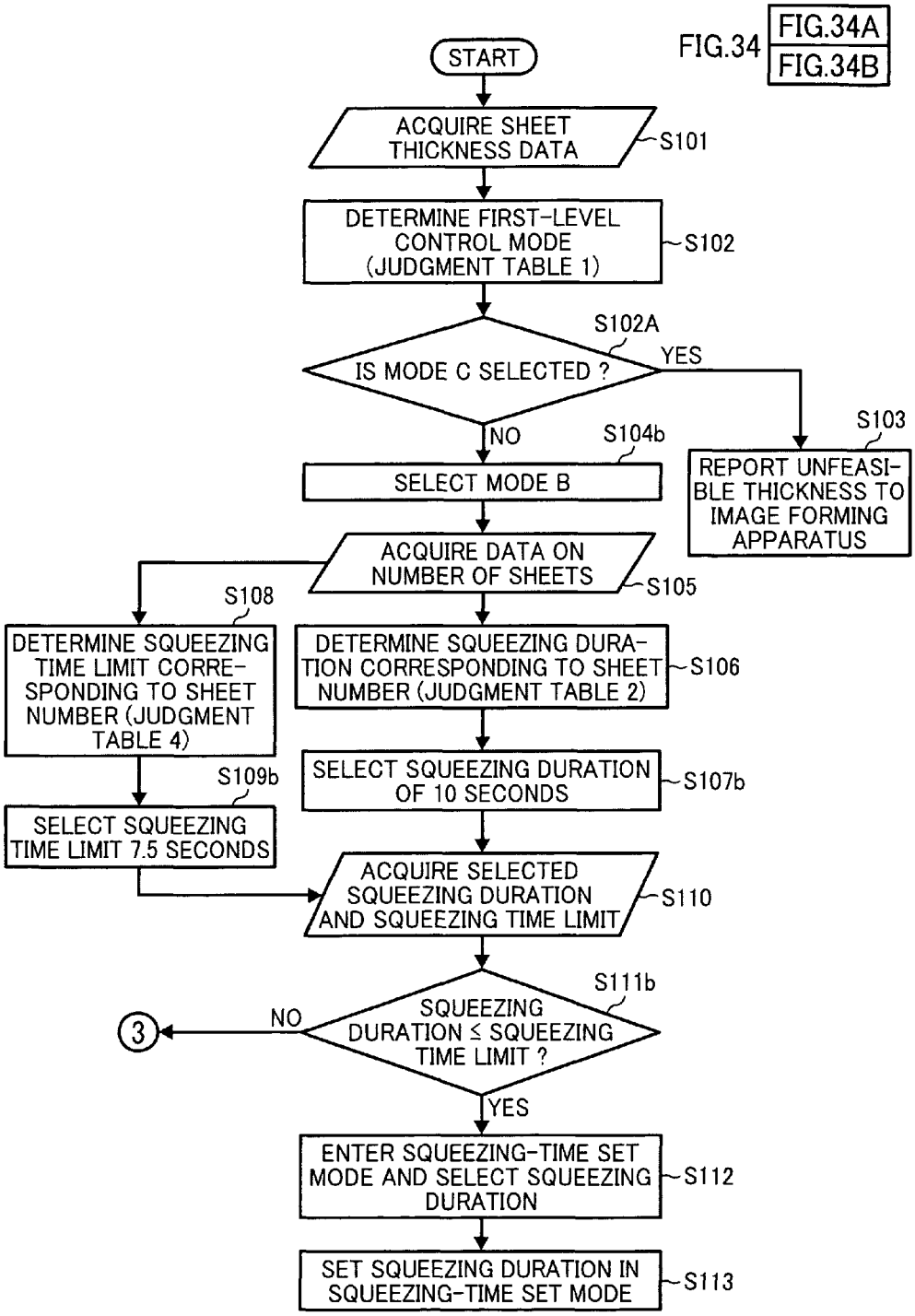
FIGS. 34A and 34B are flowcharts illustrating the procedure of control mode judgment when the spine formation device 3 is connected to the image forming apparatus having image formation capacity of 90 PPM and forms the spine of a bundle of 10 sheets whose unit weight (thickness) is 90 $g/m^2$.
Figure 34B:
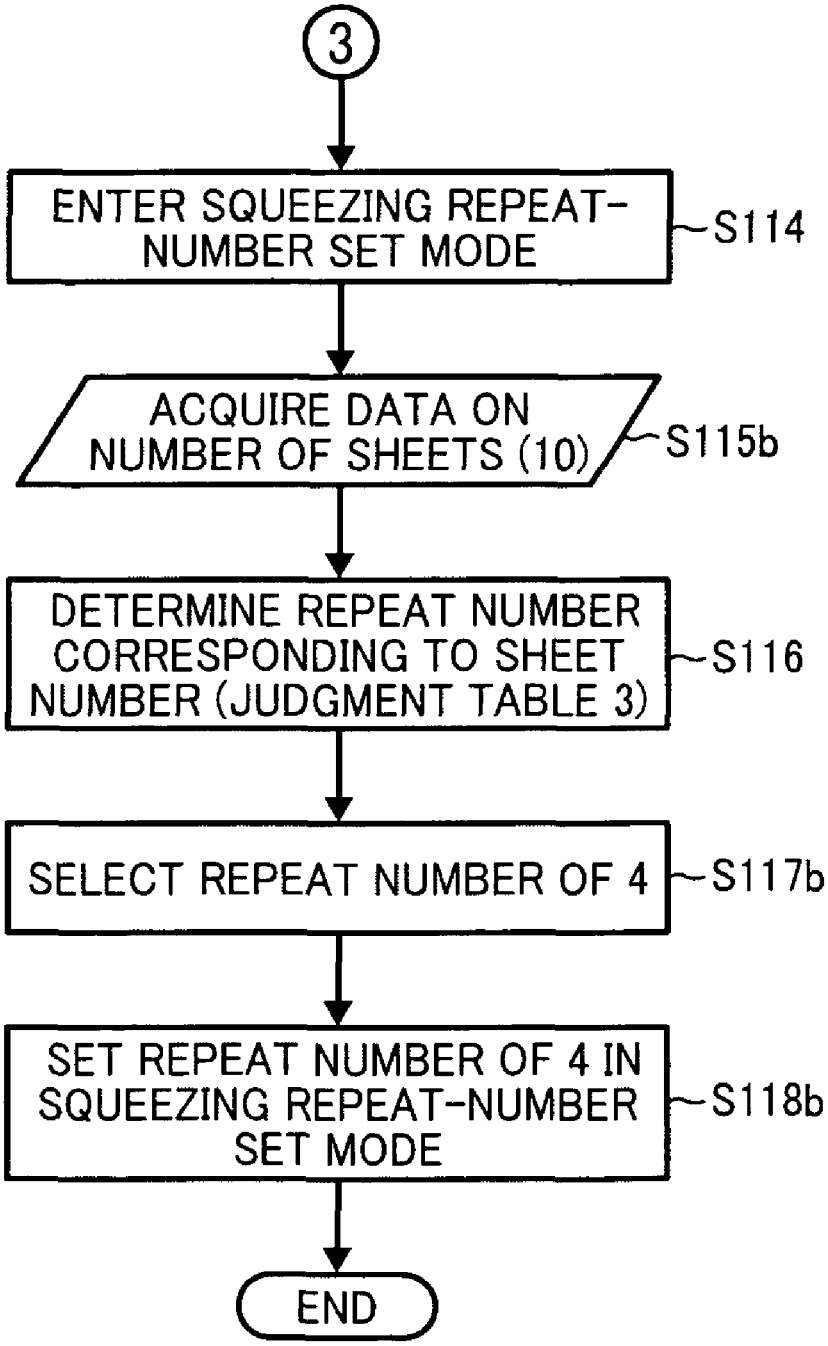

FIGS. 34A and 34B illustrate the procedure of control mode judgment when the spine formation device 3 is connected to the image forming apparatus having image formation capacity of 90 PPM and forms the spine of a bundle of 15 sheets whose unit weight (thickness) is 90 g/m$^2$.

Referring to FIGS. 19, 34A, and 34B, at S 101 the CPU 3-1 of the spine formation device 3 acquires sheet thickness data from the CPU 100-1 of the image forming apparatus 100 and, at S 102, determines sheet thickness level in accordance with the sheet thickness data using the judgment table 1 shown in FIG. 28. In this procedure, because the sheet has a thickness (unit weight) of 90 g/m$^2$, the thickness level according to the judgment table 1 is thickness level B. Therefore, at S104*b*, the CPU 3-1 of the spine formation device 3 selects thickness level B and acquires data on the number of sheets from the CPU 100-1 of the image forming apparatus 100. At S106, because the number of sheets is 15, the squeezing time corresponding to 15 sheets is determined according to the judgment table 2 shown in FIG. 29, and, at S107*b*, 10 seconds is selected as the squeezing time. Additionally, at S108, the squeezing time limit corresponding to the number of sheet is determined referring to the judgment table 4 shown in FIG. 31, and 7.5 seconds is selected as the squeezing time limit at S109*b*. At S110, the CPU 3-1 of the spine formation device 3 acquires the squeezing time selected at S107*b* as well as the squeezing time limit selected at S109*b* and determines whether or not the selected squeezing time is less than the selected squeezing time limit at S111*b*.

In this judgment, because the squeezing time is 10 seconds, which is longer than the squeezing time limit of 7.5 seconds (NO at S111*b*), the spine formation device 3 enters the squeezing repeat-number set mode at S114. After acquiring 15 as the number of sheets at S115*b*, at S 116, the CPU 3-1 of the spine formation device 3 determines number of times squeezing is repeated corresponding to the number of sheets according to the judgment table 3 shown in FIG. 30. In this judgment, at S117*b*, the repeat number is 4 according to the judgment table 3. At S118*b*, sheet thickness level B, the squeezing repeat-number set mode, and the repeat number of 4 are set as spine formation conditions.

By determining the spine formation control mode using the flowchart for mode determination shown in FIGS. 32A and 32B, booklets ca be squeezed to target finished thicknesses in the bookbinding system to which the image forming apparatus 100 and the like are connected without stopping the system. Additionally, the bookbinding and spine formation can be performed efficiently.

Additionally, although the reference pressure is determined in accordance with sheet thickness data in the first step the description above, alternatively, in the first step, the squeezing repeat-number set mode may be selected and the repeat number may be determined, and then the squeezing time may be determined in accordance with the number of sheets in the second step. Further, if the squeezing time exceeds the feasible squeezing time of the system, the pressure to sandwich the booklet may be increased and the set values may be determined based on experimental data for data of each booklet so that the target finished thickness can be attained. Thus, the spine formation control mode may be switched according to data of the booklet.

Additionally, the present embodiment can provides a computer program product such as a computer-useable storage medium having a computer-readable program stored thereon and which, when executed by a computer, causes the computer to carry out the above-described method for controlling the spine formation.

As described above, according to the present embodiment, efficient process conditions such as the pressure and the number of repetitions are selected in accordance with the number of sheets, sheet thickness, and sheet type for spine formation of booklets. Consequently, bulging of booklets can be reduced efficiently with a smaller energy in shorter time.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device for forming a spine of a bundle of folded sheets, the spine formation device comprising:

a sheet conveyer that conveys the bundle of folded sheets with a folded portion of the bundle of folded sheets forming a front end portion of the bundle of folded sheets;

a spine formation unit disposed downstream from the sheet conveyer in a sheet conveyance direction in which the bundle of folded sheets is transported, the spine formation unit for forming the spine of the bundle of folded sheets by squeezing the folded portion of the bundle from a folded leading side, a front side, and a back side of the bundle;

a discharge unit to discharge the bundle of folded sheets outside the spine formation device, disposed downstream form the spine formation unit in the sheet conveyance direction; and a controller operatively connected to the spine formation unit to cause the spine formation unit to operate in one of multiple selectable control modes for controlling the spine formation unit in accordance with at least one of multiple predetermined sheet-related variables, wherein the multiple control modes comprise multiple first-level control modes corresponding to a first one of the multiple predetermined sheet-related variables and multiple second-level control modes, and in the multiple second-level control modes, squeezing duration as well as the number of times squeezing is repeated are set in accordance with one of the first-level control modes and a second one of the multiple predetermined sheet-related variables.

2. The spine formation device according to claim 1, wherein the multiple predetermined sheet-related variables comprise at least one of a quantity of the folded sheets, a sheet thickness, a sheet size, and a special sheet classification.

3. The spine formation device according to claim 2, wherein the special sheet classification is data indicating one of an OHP sheet, a label sheet, a coated sheet, a sheet folded into a special shape, and a perforated sheet.

4. The spine formation device according to claim 1, wherein the first one of the multiple predetermined sheet-related variables is a sheet thickness, and the second one of the multiple predetermined sheet-related variables is a quantity of the folded sheets.

5. The spine formation device according to claim 1, wherein a predetermined squeezing time limit in each of the multiple first-level control modes is determined in accordance with the second one of the multiple predetermined sheet-related variables and a quantity per unit time of sheets transported from an apparatus to which the spine formation device is connected and from which the bundle of folded sheets is output to the spine formation device.

6. The spine formation device according to claim 5, wherein the controller:

determines squeezing duration by the spine formation unit in accordance with the second one of the multiple predetermined sheet-related variables in each of the first-level control modes;

selects one of the multiple second-level control modes in accordance with one of the first-level control modes and whether or not the determined squeezing duration exceeds the predetermined squeezing time limit; and sets the squeezing duration as well as the number of times squeezing is repeated in the selected second-level control mode in accordance with the second one of the multiple predetermined sheet-related variables.

7. The spine formation device according to claim 6, wherein the second-level control modes comprise a squeezing-time set mode in which duration of squeezing by the spine formation unit is increased and a squeezing repeat-number set mode in which the number of times squeezing is repeated is increased, such that, when the determined squeezing duration is within the squeezing time limit, the spine formation device enters the squeezing-time set mode and the determined squeezing duration is set, and, when the determined squeezing duration exceeds the squeezing time limit, the spine formation device enters the squeezing repeat-number set mode and the number of times squeezing is repeated is increased.

8. The spine formation device according to claim 1, wherein the spine formation unit includes a first sandwiching unit, a second sandwiching unit, and a contact member including a flat contact surface against which the folded portion of the bundle of folded sheets is pressed, disposed in that order in the sheet conveyance direction, and the controller causes the first sandwiching unit to localize a bulging of the bundle of folded sheets created between the sheet conveyer and the contact member to a downstream side in the sheet conveyance direction by squeezing the bundle of folded sheets in a direction of thickness of the bundle of folded sheets with the folded portion pressed against the contact member and causes the second sandwiching unit to form a spine of the bundle of folded sheets by squeezing a bulging of the bundle of folded sheets created between the first sandwiching unit and the contact member.

9. A method for controlling a spine formation device for forming a spine of a bundle of folded sheets, the spine formation device including a spine formation unit for squeezing a folded portion of the bundle from a folded leading side, a front side, and a back side of the bundle, the method comprising:

a step of selecting one of multiple control modes for controlling the spine formation unit in accordance with at least one of multiple predetermined sheet-related variables in the bundle; and a step of operating the spine formation unit in the selected one of multiple control modes, wherein the step of selecting one of multiple control modes comprises:

selecting one of multiple first-level control modes corresponding to a first one of the multiple predetermined sheet-related variables;

determining squeezing duration in the selected first-level control mode in accordance with a second one of the multiple predetermined sheet-related variables;

acquiring a squeezing time limit corresponding to the second one of the multiple predetermined sheet-related variables;

comparing the determined squeezing duration with the acquired squeezing time limit;

selecting one of multiple second-level control modes based on whether or not the determined squeezing duration exceeds the acquired squeezing time limit; and setting the squeezing duration and number of times squeezing is repeated in the selected second-level control mode in accordance with the second one of the multiple predetermined sheet-related variables.

10. The method according to claim 9, wherein the second-level control modes comprise a squeezing-lime set mode in which duration of squeezing the bundle of folded sheets is increased and a squeezing repeat-number set mode in which the number of times squeezing is repeated is increased, when the determined squeezing duration is within the acquired squeezing time limit, the spine formation device enters the squeezing-time set mode and the determined squeezing duration is set, and when the determined squeezing duration exceeds the acquired squeezing time limit, the spine formation device enters the squeezing repeat-number set mode and the number of times squeezing is repeated is increased.

11. The method according to claim 9, wherein the squeezing time limit is set in accordance with a quantity per unit time of sheets transported from an apparatus to which the spine formation device is connected and from which the bundle of folded sheets is output to the spine formation device, as well as the second one of the multiple predetermined sheet-related variables.

* * * * *